US005085970A

United States Patent [19]

Kameoka et al.

[11] Patent Number: 5,085,970

[45] Date of Patent: * Feb. 4, 1992

[54] IMAGE FORMING METHOD

[75] Inventors: Kimitaka Kameoka; Ken-ichi Kuwabara; Toshiro Takahashi; Shigenori Moriuchi; Morio Yagihara; Yoshio Inagaki; Keiichi Adachi, all of Kanagawa, Japan

[73] Assignee: Fuji Photo Film Co., Ltd., Kanagawa, Japan

[ * ] Notice: The portion of the term of this patent subsequent to Feb. 7, 2006 has been disclaimed.

[21] Appl. No.: 581,435

[22] Filed: Sep. 13, 1990

Related U.S. Application Data

[63] Continuation of Ser. No. 243,142, Sep. 9, 1988, abandoned, which is a continuation-in-part of Ser. No. 24,757, Mar. 11, 1987, abandoned.

[30] Foreign Application Priority Data

Mar. 11, 1986 [JP] Japan ..... 61-53461
Apr. 7, 1986 [JP] Japan ..... 61-79531

[51] Int. Cl.[5] ..... G03C 5/04; G03C 1/36

[52] U.S. Cl. ..... 430/264; 430/396; 430/512; 430/606; 430/494

[58] Field of Search ..... 430/396, 512, 264, 265, 430/302, 605, 606, 494

[56] References Cited

U.S. PATENT DOCUMENTS 4,168,977 9/1979 Takada et al. ..... 430/949
4,362,809 12/1982 Chen et al. ..... 430/396
4,416,522 11/1983 Webster ..... 430/338
4,452,882 6/1984 Akimura et al. ..... 430/441
4,619,892 10/1986 Simpson et al. ..... 430/505
4,722,884 2/1988 Inoue et al. .
4,803,149 2/1989 Takahashi et al. ..... 430/264

FOREIGN PATENT DOCUMENTS 138200 4/1985 European Pat. Off. .
164120 12/1985 European Pat. Off. .
1274365 5/1972 United Kingdom .
2131190 6/1984 United Kingdom .

OTHER PUBLICATIONS

*The Theory of the Photographic Process*, 4th ed. New York, Macmillan Publishing Co., Inc., 1977, p. 355.

*Primary Examiner*—Richard L. Schilling
*Attorney, Agent, or Firm*—Sughrue, Mion, Zinn Macpeak & Seas

[57] ABSTRACT

A method for forming an image is disclosed which comprises providing a photosensitive material comprising at least one light-sensitive layer and having a gamma value of not less than 10 and a capability of being handled under bright light, subjecting said light-sensitive layer image-wise exposure to light having substantially exclusive of wavelengths of 370 nm or shorter through originals, for example, a line original and a halftone original arranged in a superposed condition, followed by contrast development processing, whereby excellent quality of images, for example, letter images, can be obtained.

12 Claims, 3 Drawing Sheets

IMAGE FORMING METHOD

This is a continuation of application No. 07/243,142 filed Sept. 9, 1988, now abandoned, which is a continuation-in-part of application Ser. No. 07/024,757 filed Mar. 11, 1987, now abandoned.

FIELD OF THE INVENTION

The present invention relates to a method for forming an image using a photosensitive material, particularly a bright room-type photosensitive material which can be handled under bright light during steps of the photomechanical process.

BACKGROUND OF THE INVENTION

In the field of forming duplicates in the graphic arts, it is required to increase work efficiency for coping with variety and complexity of printed matter.

Particularly in the lay-out process and in the contact process, work efficiency is improved by carrying out work under a more well-lightened environment. With this aim, presensitized plates capable of being handled under bright light and exposing printers have been developed.

The terminology "bright room-type photosensitive material" as used herein refers to photosensitive materials which can be used for a long period of time (not less than 5 minutes) under safelight (200 lux) not having a wavelength in the ultraviolet portion but consisting substantially of a wavelength of 400 nm or longer without substantial changes in photographic properties such that the 50% dot image can be reproduced with the change in dot areas of not more than 2% and the increase in fog of not more than 0.02.

The bright room-type photosensitive material to be employed in the lay-out process and contact process is a material for effecting negative-positive conversion or positive-positive conversion by using as an original a development-processed film having letter images or dot images and subjecting the original and the material to contact exposure (hereafter referred to as "contact-type photographic material"). Such a bright room-type photosensitive material is required to have (1) the property of effecting negative-positive conversion or positive-positive conversion of dot image, line image, and letter image in accordance with individual dot areas, line widths, and letter line widths of the original, and (2) the property of permitting the tone control of dot image, and line width control of line image and letter image. So far, bright room- and contact-type photosensitive materials capable of meeting such requirements have been provided.

However, in sophisticated image-conversion work of forming superimposed letter images through a superposed contact process, the conventional method of using a bright room-type photosensitive material and carrying out the contact process in a bright room has been found to have a defect of providing superimposed letter images inferior in quality to those provided by the method of using a conventional darkroom- and contact-type photosensitive material and carrying out the contact process in a bright room.

The method for forming superimposed letter images through the contact process is described in more detail below.

As shown in FIG. 1, letter or line image-forming film (line original) (b) and dot image-formed film (dot original) (d) are laminated on transparent or translucent bases (a) and (c), respectively, and the laminated bases are superposed to be used as an original wherein a polyethylene terephthalate film having a thickness of about 100 μm is generally used as the bases. Dot original (d) is brought into direct contact with an emulsion surface of contact-type photosensitive material (e), and subjected to light exposure. The contact-type photosensitive material is then developed to produce white areas corresponding to line image in dot image.

In such a method for forming a superimposed letter image, it is highly desired that negative-positive conversion or positive-positive conversion be effected in accordance with individual dot areas of a dot original and individual line widths of a line original, respectively. However, as is apparent from FIG. 1, exposure for printing of line original (b) on contact-type photosensitive material (e) is carried out through base (c) and dot original (d), while dot original (d) is printed by exposure in direct contact with the emulsion surface of contact-type photosensitive material (e).

Therefore, the optimum exposure amount for accomplishing faithful negative-positive conversion or positive-positive conversion with respect to dot original (d) results in out of focus for line original (b) due to base (c) and dot original (d) interposed as a spacer. As the result, narrowing of the line width of white-printed image corresponding to the line original takes place. This is the cause for deterioration in quality of the superimposed letter image. This phenomenon is largely affected by the kind of an exposure source used other than the photographic property of the contact-type photosensitive material.

SUMMARY OF THE INVENTION

Therefore, an object of the present invention is to provide a method for forming an image excellent in quality of superimposed letter image through a contact process using a bright room- and contact-type photosensitive material which can be handled under safelight.

It has been found that the above-described object can be achieved by an image forming method which comprises providing a photosensitive material comprising at least one light-sensitive layer and having a $\gamma$ value (the definition of which is given hereinafter) of not less than 10 and a capability of being handled under bright light, and subjecting said light-sensitive layer to imagewise exposure to light substantially exclusive of wavelengths of 370 nm or shorter.

DETAILED DESCRIPTION OF THE INVENTION

Figure 1:
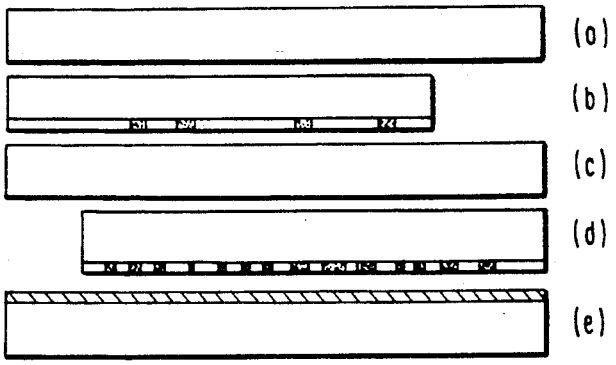
FIG. 1 is a schematic illustration of a configuration of basic elements for forming superimposed letter images through the contact process when exposed to light, wherein (a) represents a transparent or translucent base, (b) represents a line original (the black parts being line images), (c) represents a transparent or translucent base, (d) represents a dot original (the black parts being dot images), and (e) represents a contact-type photosensitive material (the hatched portion being a light-sensitive layer).

As a result of extensively studying conditions for the contact process under which change in quality of letter images formed by using a darkroom contact-type photosensitive material and carrying out the contact process in darkroom can be minimized, it has now been discovered that in the combination of a photosensitive material and a method for exposing the following conditions should be satisfied in order to obtain a high quality of letter images.

One condition relates to a property of the photosensitive material. Specifically, the condition (1) is that the photosensitive material should have a $\gamma$ value of 10.0 or more. Herein, $\gamma$ is defined as follows:

$$\gamma = \frac{3.0 - 0.3}{\log E_{3.0} - \log E_{0.3}}$$

wherein $E_{3.0}$ represents an exposure amount necessary to yield a density of 3.0, and $E_{0.3}$ represents an exposure amount necessary to yield a density of 0.3.

Another condition relates to a light source to be used for exposure. Specifically, the condition (2) is that a light source of such a kind that an exposure applied to the contact-type photosensitive material can have slight dependence on the number of original sheets is used, even if there is a difference in the number of sheets which constitute the composite original, including bases, line original films, and dot original films.

Various methods and systems can be employed in order to form images having a gradation ($\gamma$) of 10 or more in the present invention.

For instance, systems utilizing silver halide photographic emulsions are known. In such systems, negative images are generally obtained.

More specifically, there is a method for processing a lithographic silver halide photosensitive material, which comprises silver chlorobromide, with a hydroquinone developer (lith developer) having a very low sulfite ion concentration (0.1 mol/l or less), i.e., a so-called lithographic development system.

Another system for forming a contrasty image is disclosed in Japanese Patent Application (OPI) No. 190943/83 (the term "OPI" as used herein means "unexamined published patent application") wherein the above-described lithographic silver halide photosensitive material is developed with a hydroquinone developer having a high sulfite ion concentration (0.2 mol/l or more), a high pH value (10.5 or higher), and, containing a nitroindazole compound (hereafter referred to as "fast-access super-stabilized lithographic (FSL) development system").

A further method for obtaining high contrast is a method comprising processing a tetrazolium compound-containing photosensitive material with a PQ or MQ developer containing a sulfite in a, relatively high concentration together with a dihydroxybenzene (hydroquinone: (Q)) as a developing agent and an auxiliary developing agent such as a 1-phenyl-3-pyrazolidone (P), or a p-aminophenol (Metol: (M)), as disclosed, for example, in Japanese Patent Application (OPI) Nos. 18317/77, 17719/78 and 17720/78 (hereafter referred to as "tetrazolium contrast development system").

Still another method for forming a very high contrast negative image is a method comprising using a surface-latent type silver halide photographic material containing a hydrazine derivative (e.g., a specific acylhydrazine compounds, as described, for example, in U.S. Pat. Nos. 4,166,742, 4,168,977, 4,221,857, 4,224,401, 4,243,739, 4,272,606, and 4,311,781) and processing the photographic material with a solution adjusted to a pH of 11.0 to 12.3 and containing 0.15 mol/l or more of sulfurous acid preservative (hereafter referred to as "hydrazine contrast development system").

A method for subjecting the light-sensitive layer to imagewise exposure to light substantially exclusive of wavelengths of 370 nm or shorter, includes (1) a method for incorporating an ultraviolet absorbent into a photosensitive material, (2) a method for using an optical filter capable of absorbing ultraviolet rays, (3) a method for using a light source which has substantially no emission energy in the wavelength region of 370 nm or shorter, and so on.

To begin, Method (1) is described in detail below.

In Method (1), an ultraviolet absorbent is used in such an amount as to reduce the intrinsic sensitivity of the silver halide emulsion to ½ or less. Suitable ultraviolet absorbents include those having their respective spectral absorption peaks in the wavelength region of from 300 to 400 nm, more preferably from 300 to 380 nm, and most preferably from 320 to 380 nm.

Specific examples of suitable ultraviolet absorbents include benzotriazole compounds substituted with an aryl group, 4-thiazolidone compounds, benzophenone compounds, cinnamate compounds, butadiene compounds, benzoxazole compounds, and ultraviolet absorbing polymers. These ultraviolet absorbents are described, for example, in U.S. Pat. Nos. 3,533,794, 3,314,794, 3,352,681, 3,705,805, 3,707,375, 4,045,229, 3,700,455, and 3,499,762, Japanese Patent Application (OPI) No. 2784/71, and West German Patent Application (OLS) No. 1,547,863.

Examples of an ultraviolet absorbent which can be employed in the present invention are illustrated below. However, the present invention is not to be construed as being limited to these compounds.

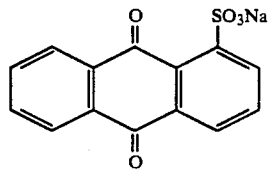

I-1

-continued
I-2
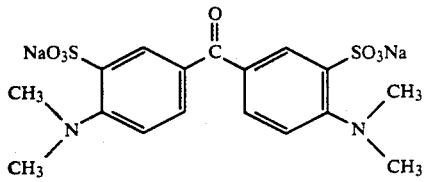
I-3
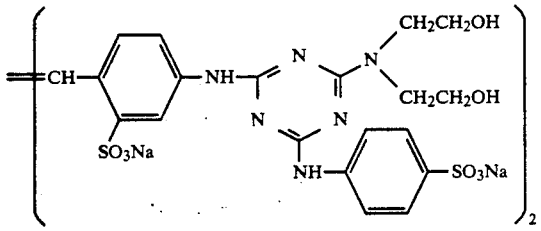
I-4
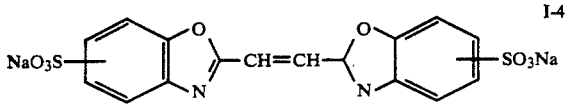
I-5
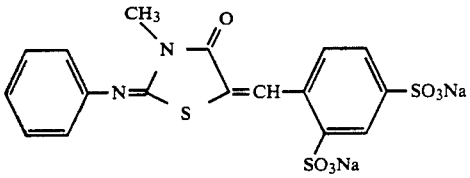
I-6
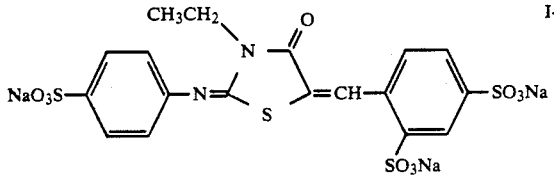
I-7
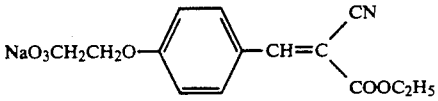
I-8
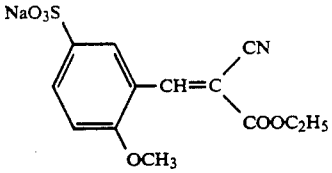
I-9
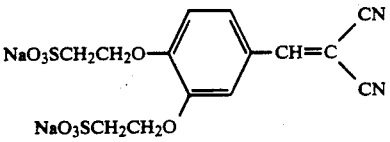
I-10
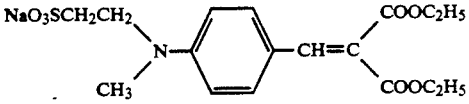
I-11
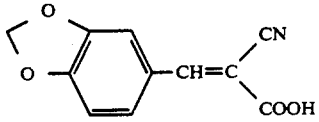
-continued
I-12
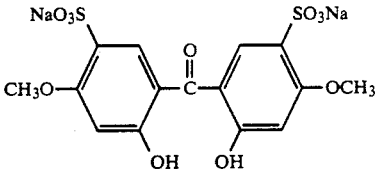
I-13
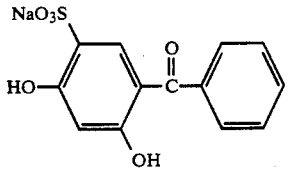
I-14
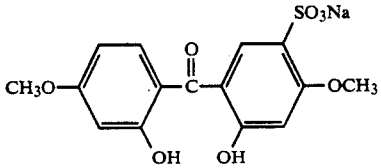
I-15
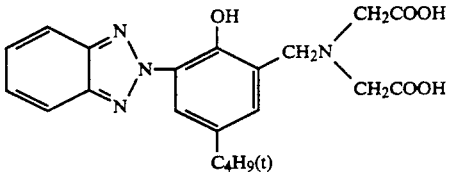
I-16
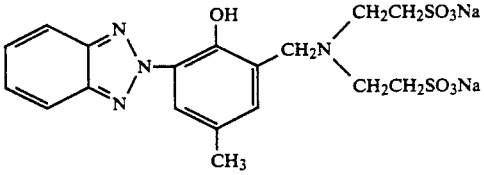
I-17
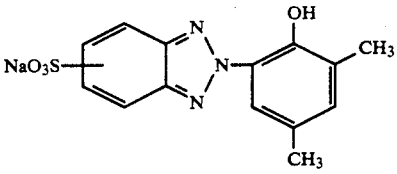
I-18
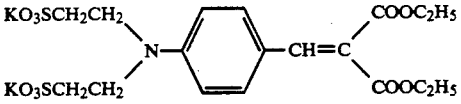
I-19
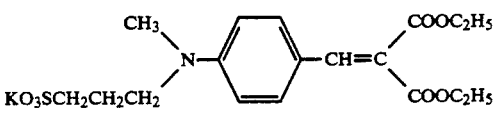
I-20
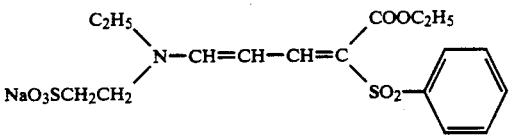

-continued

I-21

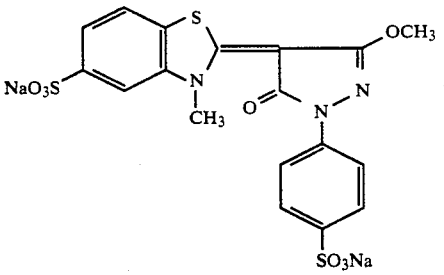

I-22

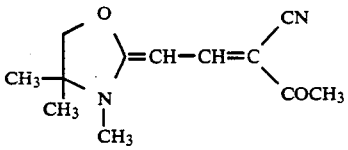

I-23

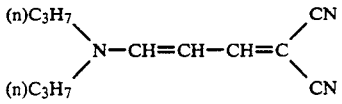

I-24

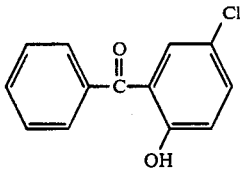

I-25

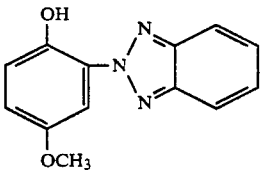

I-26

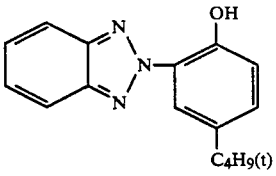

I-27

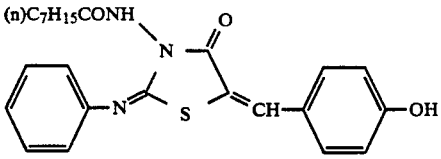

I-28

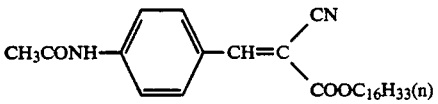

I-29

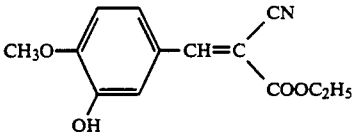

-continued

I-30

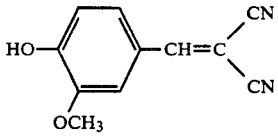

Ultraviolet absorbents as illustrated above are added in such an amount as to reduce the intrinsic sensitivity at the wavelength of 360 nm of a silver halide emulsion to ½ or less as described above, and the amount added corresponds to that yielding an absorbance of 0.3 or more, preferably 0.4 or more, at the wavelength of 360 nm.

A preferred coverage of such an ultraviolet absorbent varies depending on its molar absorptivity but generally ranges from $10^{-2}$ g/m$^2$ to 1 g/m$^2$, and preferably from 50 mg/m$^2$ to 500 mg/m$^2$.

The ultraviolet absorbent of the present invention can be incorporated into an emulsion layer, a surface protecting layer, an interlayer, and so on. Preferably, it is incorporated into a surface protecting layer.

The above-cited ultraviolet absorbents can be dissolved in a suitable solvent (e.g., water, alcohols such as methanol, ethanol, propanol, etc., acetone, methyl cellosolve, mixtures of two or more thereof), and then added to coating compositions for the light-insensitive hydrophilic colloid layers of the present invention.

These ultraviolet absorbents can be used in combinations of two or more thereof.

In the photosensitive material of the present invention, the ultraviolet absorbents and safelight dyes as described hereinafter may be present in the same layer, or different layers.

Method (2) is described in detail below.

As an ultraviolet absorbing optical filter (or a filter for light source), a filter by which light of wavelength of 370 nm or shorter is little transmitted is preferably used, such as sharp-cut filters SC-38, SC-39, SC-40, and SC-41 produced by Fuji Photo Film Co., Ltd. More specifically, filters having percent transmittance of 20% or less, preferably 10% or less, are used to more advantage.

Method (3) is described in detail below. Examples of a light source of the kind which itself has substantially no emission energy in the wavelength region of 370 nm or shorter include EYE DOLPIN produced by EYE GRAPHICS Co., Ltd., a metal halide lamp TYPE SPG-2000 (2 KW) produced by Japan Storage Battery Co., Ltd.) as a light source installed in a process printer P-603 produced by Dainippon Screen Mfg. Co., Ltd., and so on.

More specifically, preferred light sources are those having such an emission energy distribution that the emission energy in the range of from 300 to 370 nm is 30% or less, preferably 20% or less, of the whole emission energy in the wavelength region of from 300 to 420 nm.

In addition, commercially available bright room-type photosensitive materials (E. G., KUV-100, produced by FujiPhoto Film Co., Ltd.; CRH-100, produced by Konishiroku Photo Industry Co., Ltd.; etc.) can be exposed to a light source having capacity higher than conventional bright room-type lamps through an optical filter capable of blocking ultraviolet rays (i.e., filter for the light source). As a high-capacity light source to be used therein, for example, an ultra-high pressure mercury lamp H-15-L31 (15 KW; produced by EYE GRAPHIC Co., Ltd.) can be used.

In a case where optical exposure is carried out using an ultraviolet absorbing optical filter (for light source) arranged between a light source and a photosensitive material, or in another case where a layer containing an ultraviolet absorbent or the like is provided in a photosensitive material so that light substantially exclusive of wavelength of 370 nm or shorter reaches to the light-sensitive layer, conventionally known light sources can be employed. For instance, a light source for a process printer P-607, made by Dainippon Screen Mfg. Co., Ltd. (ultra-high pressure mercury lamp: ORC-CHM-1000), a light source for P-627 FM, made by the foregoing company, and so on can be used.

An exposure time to be employed in the method of the present invention is selected depending on capacity of the light source used, sensitivity (including spectral sensitivity) of the photosensitive material used, and so on, and it generally ranges from 5 seconds to 60 seconds. Under certain circumstances, long exposure times (from 2 to 3 minutes) may be employed.

Now the hydrazine contrast development system is illustrated in detail below.

Examples of the hydrazine derivative which can be used include arylhydrazines wherein a sulfinic acid residue is bonded to the hydrazo moiety as described in U.S. Pat. No. 4,478,928, which is incorporated by reference herein, and compounds represented by formula (II)

$$R_1—NHNH—G_1—R_2 \quad (II)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted aralkyl group, a substituted or unsubstituted alkoxy group, or a substituted or unsubstituted aryloxy group: and $G_1$ represents a carbonyl group, a sulfonyl group, a sulfinyl group, an N-substituted or unsubstituted iminomethylene group

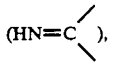

or a mono-substituted phosphoryl group represented by

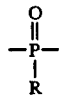

wherein R represents a substituted or unsubstituted alkoxy group, a substituted or unsubstituted alkyl group or a substituted or unsubstituted phenyl group.

The aliphatic group shown by $R_1$ in formula (II) described above preferably has from 1 to 30 carbon atoms, and is particularly preferably a straight chain, branched, or cyclic alkyl group having from 1 to 20 carbon atoms. In this case, the branched alkyl group may be cyclized to form a saturated 3- to 10-membered heterocyclic ring containing one or more hetero atoms such as an oxygen atom, a nitrogen atom, and a sulfur atom therein. Also, the alkyl group may contain a substituent such as an aryl group preferably having from 6 to 20 carbon atoms, an alkoxy group preferably having from 1 to 20 carbon atoms, a sulfinyl group preferably having from 1 to 20 carbon atoms, sulfonamido group preferably having from 1 to 20 carbon atoms, a carbonamido group preferably having from 1 to 20 carbon atoms, a saturated 3- to 10-membered heterocyclic ring containing one or more hetero atoms such as an oxygen atom, a nitrogen atom, and a sulfur atom, etc.

The aromatic group shown by $R_1$ in formula (II) is a monocyclic or bicyclic aryl group, or an unsaturated heterocyclic group (preferably a 5- or 6-membered ring containing at least one of an oxygen atom, a nitrogen atom, and a sulfur atom). The unsaturated heterocyclic group may form a heteroaryl group by the condensation with a monocyclic or bicyclic aryl group.

Examples of aromatic groups are those containing a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc., and in these groups, the groups containing a benzene ring are preferred.

The particularly preferred group represented by $R_1$ is an aryl group.

The aryl group or the unsaturated heterocyclic group shown by $R_1$ may be substituted. Specific examples of substituents are a straight chain, branched, or cyclic alkyl group (preferably having 1 to 20 carbon atoms), an aralkyl group (preferably having a monocyclic or bicyclic aryl moiety and the alkyl moiety of 1 to 3 carbon atoms), an alkoxy group (preferably having 1 to 20 carbon atoms), a substituted amino group (preferably, an amino group substituted by an alkyl group having 1 to 20 carbon atoms), an acylamino group (preferably having 2 to 30 carbon atoms), an alkyl or arylsulfonamido group (preferably having 1 to 30 carbon atoms), a substituted or unsubstituted ureido group (preferably having 1 to 30 carbon atoms), etc.

The alkyl group represented by $R_2$ in formula (II) is preferably an alkyl group having 1 to 4 carbon atoms and the alkyl group may have a substituent such as a halogen atom, a hydroxy group, a cyano group, a carboxy group, a sulfo group, an alkoxy group, a phenyl group, a hydroxyphenyl group, etc.

The aryl group shown by $R_2$ in formula (II), which may be substituted, is a monocyclic or bicyclic aryl group containing, e.g., a benzene ring. The aryl group may have a substituent such as a halogen atom, an alkyl group, a cyano group, a carboxy group, a sulfo group, etc.

The alkoxy group shown by $R_2$ in formula (II), which may be substituted, is an alkoxy group having 1 to 8 carbon atoms and may have a substituent such as a halogen atom, an aryl group, etc.

The aryloxy group shown by $R_2$ in formula (II), which may be substituted, is preferably a monocyclic group and may have a halogen atom, etc., as a substituent.

When $G_1$ is a carbonyl group, $R_2$ is preferably a hydrogen atom, a methyl group, a methoxy group, an ethoxy group, or a substituted or unsubstituted phenyl group and is particularly preferably a hydrogen atom.

When $G_1$ is a sulfonyl group, $R_2$ is preferably a methyl group, an ethyl group, a phenyl group, or a 4-methylphenyl group and is particularly preferably a methyl group.

When $G_1$ is a mono-substituted phosphoryl group, $R_2$ is preferably a methoxy group, an ethoxy group, a butoxy group, a phenoxy group, or a phenyl group and is particularly preferably a phenoxy group.

When $G_1$ is a sulfinyl group, $R_2$ is preferably a cyanobenzyl group, a methylthiobenzyl group, etc.

When $G_1$ is an N-substituted or unsubstituted iminomethylene group, $R_2$ is preferably a methyl group, an ethyl group or a substituted or unsubstituted phenyl group.

$R_1$ or $R_2$ in formula (II) described above may contain therein a ballast group which is conventionally used as an additive for immobilization, such as of a coupler, etc. A ballast group is a group having at least 8 carbon atoms and relatively inert photographic property and can be selected from, for example, alkyl groups, alkoxy groups, phenyl groups, alkylphenyl groups, phenoxy groups, alkylphenoxy groups, etc.

$R_1$ or $R_2$ in formula (II) may include therein a group increasing adsorption on the surface of silver halide grains. Examples of such an adsorptive group include a thiourea group, a heterocyclic thiamido group, a mercapto heterocyclic group, a triazole group, etc., described in U.S. Pat. Nos. 4,385,108 and 4,459,347.

$G_1$ in formula (II) is most preferably a carbonyl group.

Specific examples of compounds represented by formula (II) are illustrated below but the invention is not to be construed as being limited to these compounds.

II-1

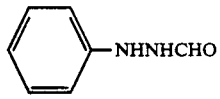

II-2

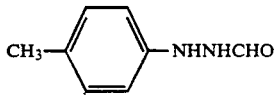

II-3

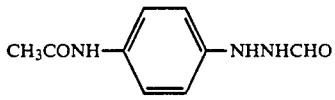

II-4

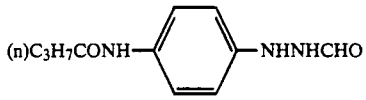

II-5

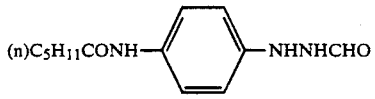

II-6

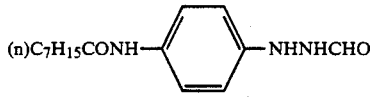

II-7

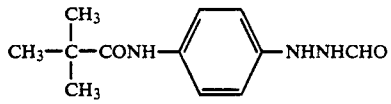

II-8

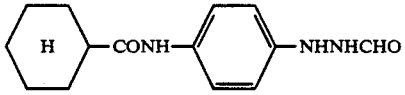

II-9

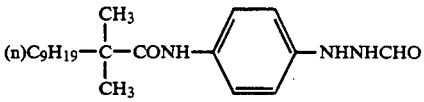

II-10

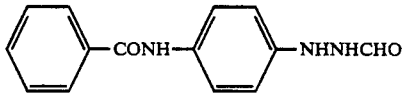

II-11

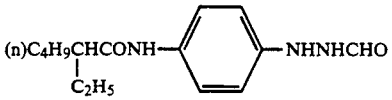

-continued
II-12
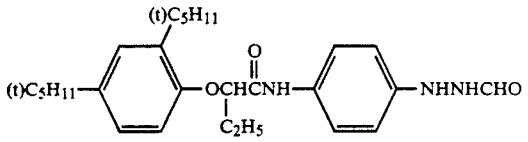
II-13
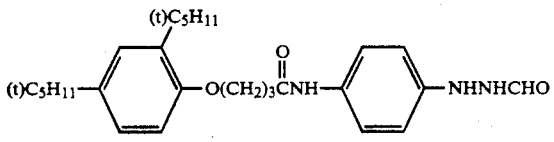
II-14
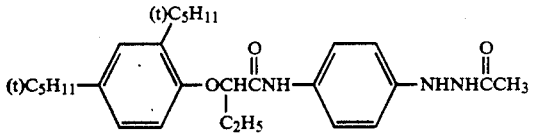
II-15
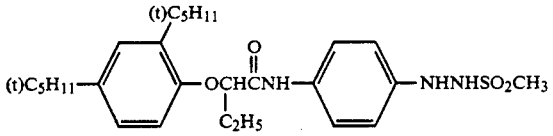
II-16
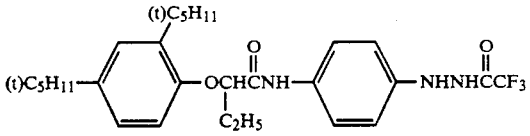
II-17
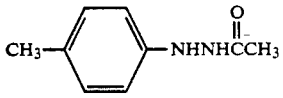
II-18
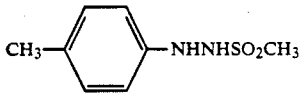
II-19
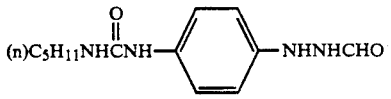
II-20
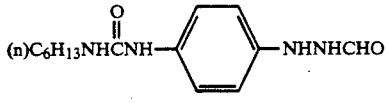
II-21
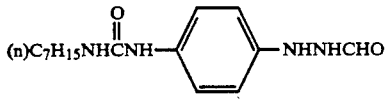
II-22
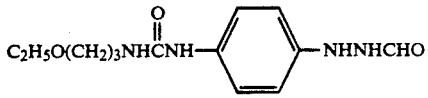
II-23
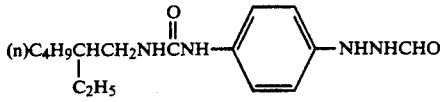

-continued
II-24
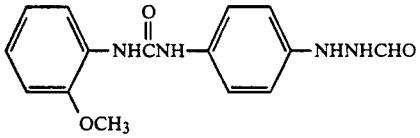
II-25
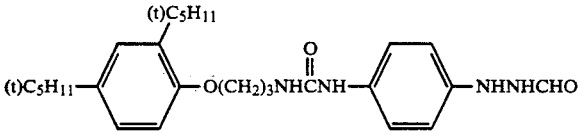
II-26
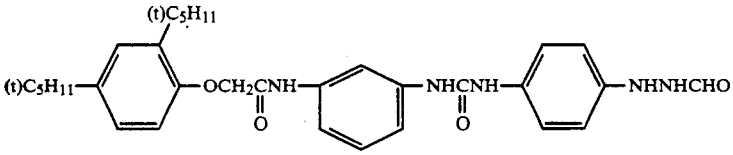
II-27
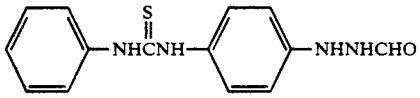
II-28
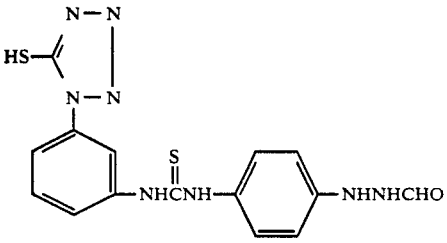
II-29
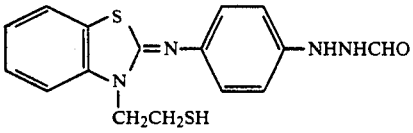
II-30
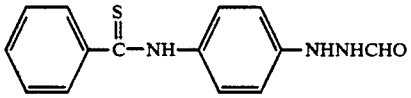
II-31
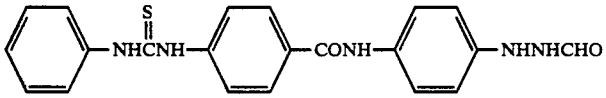
II-32
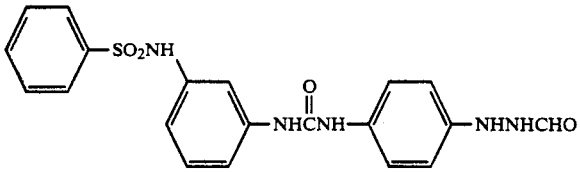

-continued
II-33
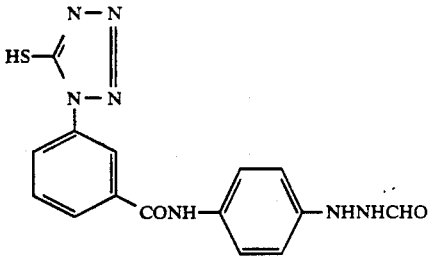
II-34
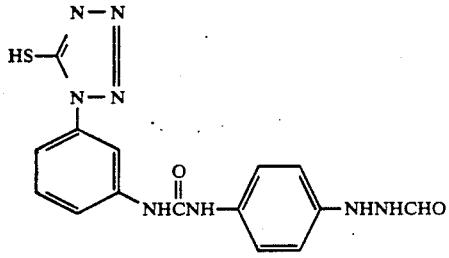
II-35
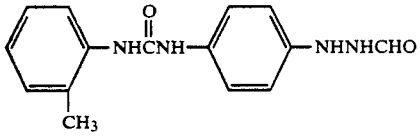
II-36
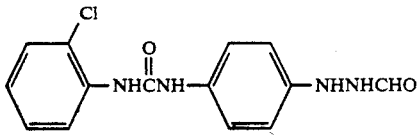
II-37
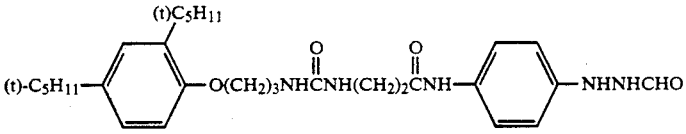
II-38
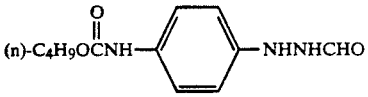
II-39
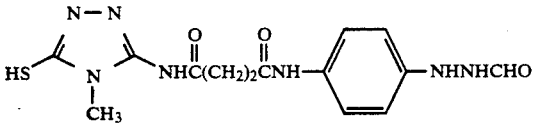
II-40
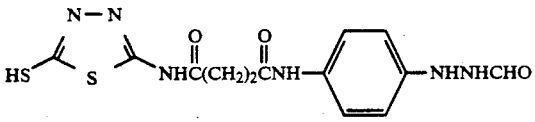
II-41
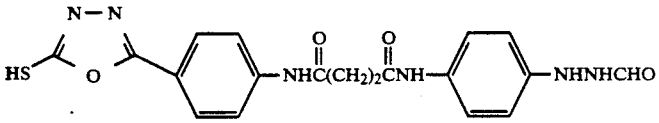
II-42
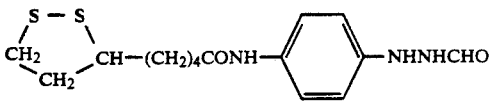

In this invention, it is preferred that the hydrazine derivative is incorporated in a silver halide emulsion in an amount, preferably, of from $1\times10^{-6}$ mol to $5\times10^{-2}$ mol, and particularly preferably from $1\times10^{-5}$ mol to $2\times10^{-2}$ mol, per mol of silver halide.

For incorporating the hydrazine derivative in a photosensitive material in this invention, the hydrazine derivative may be added to a silver halide emulsion or a hydrophilic colloidal solution as an aqueous solution when it is water soluble or as a solution in an organic solvent compatible with water, such as an alcohol (e.g., methanol, ethanol, etc.), an ester (e.g., ethyl acetate, etc.), a ketone (e.g., acetone, etc:), etc., when it is insoluble in water.

In this invention, the hydrazine derivatives may be used alone or as a mixture of two or more thereof.

The tetrazolium contrast development system is described in detail below.

Examples of tetrazolium compounds which can be used in the tetrazolium contrast development system are the compounds described in U.S. Pat. No. 4,175,966, Japanese Patent Application (OPI) Nos. 17719/78, 17720/78, etc., and typical examples thereof are compounds shown by formulae (IIIa), (IIIb), and (IIIc):

(IIIa)

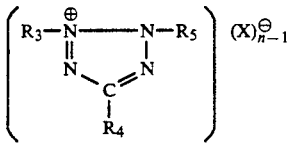

(IIIb)

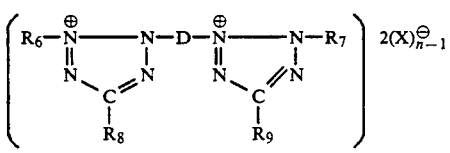

(IIIc)

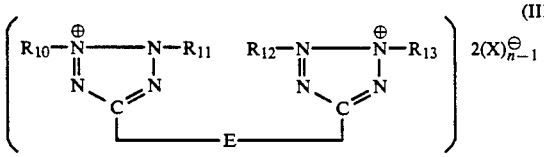

In the above formulae, $R_3$, $R_5$, $R_6$, $R_7$, $R_{10}$ $R_{11}$, $R_{12}$, and $R_{13}$ each represents an allyl group, a phenyl group (e.g., a phenyl group, a tolyl group, a hydroxyphenyl group, a carboxyphenyl group, an aminophenyl group, a mercaptophenyl group, etc.), a naphthyl group (e.g., an α-naphthyl group, a β-naphthyl group, a hydroxynaphthyl group, a carboxynaphthyl group, an aminonaphthyl group, etc.), or a heterocyclic group (e.g., a thiazolyl group, a benzothiazolyl group, an oxazolyl group, a pyrimidinyl group, a pyridyl group, etc.), which may form a metal chelate or complex; $R_4$, $R_8$, and $R_9$ each represents an allyl group, a phenyl group (e.g., a phenyl group, a tolyl group, a hydroxyphenyl group, a carboxyphenyl group, an aminophenyl group, a mercaptophenyl group, etc.), a naphthyl group (e.g., an α-naphthyl group, a β-naphthyl group, a hydroxynaphthyl group, a carboxynaphthyl group, an aminonaphthyl group, etc.), a heterocyclic group, an alkyl group (e.g., a methyl group, an ethyl group, a propyl group, a butyl group, a mercaptomethyl group, a mercaptoethyl group, etc.), a hydroxy group, a carboxy group or a salt thereof, an alkoxycarbonyl group (e.g., a methoxycarbonyl group, an ethoxycarbonyl group, etc.), an amino group (e.g., an amino group, an ethylamino group, an anilino group, etc.), a mercapto group, a nitro group, a cyano group, or a hydrogen atom; D represents a divalent aromatic group; E represents an alkylene group, an allylene group, or an aralkylene group (e.g.,

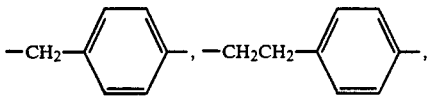

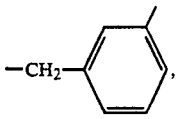

etc.); X represents an anion-forming atom or atomic group (e.g., a chlorine atom, a bromine atom, a perchloric acid, a sulfonic acid, a nitric acid, p-toluenesulfonic acid, etc.); and n represents 1 or 2. When the compound forms an intramolecular salt, n is 1.

Specific examples of the tetrazolium compound for use in this invention are shown below but the invention is not to be construed as being limited to these compounds.

III-1: 2-(benzothiazol-2-yl)-3-phenyl-5-dodecyl-2H-tetrazolium bromide
III-2: 2,3-Diphenyl-5-(4-t-octyloxyphenyl)-2H-tetrazolium chloride
III-3: 2,3,5-Triphenyl-2H-tetrazolium
III-4: 2,3,5-Tri(p-carboxyethylphenyl)-2H-tetrazolium
III-5: 2-(Benzothiazol-2-yl)-3-phenyl-5-(o-chlorophenyl)-2H-tetrazolium
III-6: 2,3-Diphenyl-2H-tetrazolium
III-7: 2,3-Diphenyl-5-methyl-2H-tetrazolium
III-8: 3-(p-Hydroxyphenyl)-5-methyl-2-phenyl-2H-tetrazolium
III-9: 2,3-Diphenyl-5-ethyl-2H-tetrazolium
III-10: 2,3-Diphenyl-5-n-hexyl-2H-tetrazolium
III-11: 5-Cyano-2,3-diphenyl-2H-tetrazolium
III-12: 2-(Benzothiazol-2-yl)-5-phenyl-3-(4-tolyl)-2H-tetrazolium
III-13: 2-(Benzothiazol-2-yl)-5-(4-chlorophenyl)-3-(4-nitrophenyl)-2H-tetrazolium
III-14: 5-Ethoxycarbonyl-2,3-di(3-nitrophenyl)-2H-tetrazolium
III-15: 5-Acetyl-2,3-di(p-ethoxyphenyl)-2H-tetrazolium
III-16: 2,5-Diphenyl-3-(p-tolyl)-2H-tetrazolium
III-17: 2,5-Diphenyl-3-(p-iodophenyl)-2H-tetrazolium
III-18: 2,3-Diphenyl-5-(p-diphenyl)-2H-tetrazolium
III-19: 5-(p-Bromophenyl)-2-phenyl-3-(2,4,6-trichlorophenyl)-2H-tetrazolium
III-20: 3-(p-Hydroxyphenyl)-5-(p-nitrophenyl)-2-phenyl-2H-tetrazolium
III-21: 5-(3,4-Dimethoxyphenyl)-3-(2-ethoxyphenyl)-2-(4-methoxyphenyl)-2H-tetrazolium
III-22: 5-(4-Cyanophenyl)-2,3-diphenyl-2H-tetrazolium
III-23: 3-(p-Acetamidophenyl)2,5-diphenyl-2H-tetrazolium
III-24: 5-Acetyl-2,3-diphenyl-2H-tetrazolium
III-25: 5-(Furu-2-yl)-2,3-diphenyl-2H-tetrazolium
III-26: 5-(Thien-2-yl)-2,3-diphenyl-2H-tetrazolium
III-27: 2,3-Diphenyl-5-(pyrido-4-yl)-2H-tetrazolium
III-28: 2,3-Diphenyl-5-(quinol-2-yl)-2H-tetrazolium III-29: 2,3-Diphenyl-5-(benzoxazol-2-yl)-2H-tetrazolium
III-30: 2,3-Diphenyl-5-nitro-2H-tetrazolium
III-31: 2,2',3,3'-Tetraphenyl-5,5'-1,4-butylene-di-(2H-tetrazolium)
III-32: 2,2',3,3'-Tetraphenyl-5,5'-p-phenylene-di-(2H-tetrazolium)
III-33: 2-(4,5-Dimethylthiazol-2-yl)-3,5-diphenyl-2H-tetrazolium
III-34: 3,5-Diphenyl-2-(triazin-2-yl)-2H-tetrazolium
III-35: 2-(Benzothiazol-5-yl)-3-(4-methoxyphenyl)-5-phenyl-2H-tetrazolium When the tetrazolium compound is to be used as a non-diffusible compound, a non-diffusible tetrazolium compound is obtained by reacting the diffusible compound in the above-described compounds and an anion.

Suitable anions which can be used in this case, include higher alkylbenzenesulfonic acid anions such as p-dodecylbenzenesulfonic acid anion, etc., higher alkylsulfuric acid ester anions such as lauryl sulfonate anion, etc., dialkyl sulfosuccinate anions such as di-2-ethylhexyl sulfosuccinate anion, etc., polyether alcohol sulfuric acid ester anions such as cetyl polyethenoxy sulfate anion, etc., higher fatty acid anions such as stearic acid anion, etc., acid radical-having polymers such as polyacrylic acid anion, etc.

By suitably selecting the anion moiety and the cation moiety, the non-diffusible tetrazolium compound for use in this invention can be synthesized.

In using the non-diffusible tetrazolium compounds, each of the anion moiety and the cation moiety as a soluble salt, is dispersed in a gelatin solution, and after mixing the dispersions together, the mixture is dispersed in a gelatin matrix; or the crystal of the non-diffusible tetrazolium compound is previously synthesized, the crystal is dissolved in a suitable solvent ( e.g., dimethylsulfoxide) and then the product is dispersed in gelatin matrix. For uniformly dispersing, a proper homogenizer such as an ultrasonic homogenizer or Manton-Gaulin homogenizer may be used.

As described above, as the tetrazolium compound for use in this invention, both a diffusible tetrazolium compound and a non-diffusible tetrazolium compound can be used, but images of higher contrast are obtained when a non-diffusible tetrazolium compound is used. Accordingly, when particularly excellent dot performance is required, it is relatively advantageous to use a non-diffusible tetrazolium compound.

The tetrazolium compounds for use in this invention may be used alone or as a mixture thereof.

It is preferred that the tetrazolium compound to be used in the range of from $1\times10^{-3}$ to $5\times10^{-2}$ mol per mol of silver halide.

The foregoing hydrazine derivatives or tetrazolium compounds may be added to either a silver halide emulsion layer or a hydrophilic colloid layer, or to both of them.

Next, photographic emulsions which can be employed in the hydrazine or tetrazolium contrast development system are described below.

Silver halide used in the photographic emulsions are not particularly restricted, and any halide compositions, such as silver chloride, silver chlorobromide, silver iodobromide, etc., can be used. However, silver chloride and silver chlorobromide are preferred among them.

As for the silver chlorobromide, those having a chloride content of not less than 80 mol %, preferably not less than 90 mol %, and particularly preferably not less than 95 mol %, can bring about a good result.

The silver halide emulsion may or may not be chemically sensitized, but chemically unsensitized emulsions are particularly preferred. Sulfur sensitization, reduction sensitization, and noble metal sensitization are known as methods for chemical sensitization, and any methods may be employed independently or in combination, with sulfur sensitization being preferred. Suitable sulfur sensitizers include not only sulfur compounds contained in gelatin, but also various sulfur compounds, e.g., thiosulfates, thioureas, rhodanines, etc.

A typical noble metal sensitization is a gold sensitization and as a gold compound, gold complex salts are mainly used. In the noble metal sensitization, noble metals other than gold may also be used, and examples include complex salts of platinum, palladium, rhodium, etc. Specific examples thereof are described in U.S. Pat. No. 2,448,060, British Patent 618,061, etc.

For the reduction sensitization method, stannous salts, amines, formamidinesulfinic acid, silane compounds, etc., can be used as reduction sensitizers. Specific examples thereof are described in U.S. Pat. Nos. 2,487,850, 2,518,698, 2,983,609, 2,983,610, 2,694,637, etc.

The mean grain size of the silver halide grains used is preferably less than 0.7 μm, and particularly preferably from 0.5 μm to 0.1 μm. The term "mean grain size" of silver halide is conventionally used in the silver halide photographic field and the term is well known and easily understood. "Grain size" as used herein means the diameter of the grain when the grain is a sphere or a grain closely resembling a sphere. When the grain is a cube, "grain size" means the length shown by the equation, [length of the side]$\times\sqrt{4/\pi}$. The mean grain size is obtained by the algebric mean value or geometrical mean value based on the mean grain projected area. Detailed methods of obtaining mean grain sizes are described in C. E. Mees & T. H. James, *The Theory of the Photographic Process,* 3rd Ed., pp 36–43, Macmillan & Co. (1966).

There is no particular restriction on the form of silver halide grains and the grains may have a tabular form, a spherical form, a cubic form, a tetradecahedral form, a regular octahedral form, etc. Also, it is preferred that the distribution of the grain size be narrow. In particular, a so-called monodisperse silver halide emulsion wherein at least 90%, and preferably at least 95%, of the total silver halide grains are in the grain size range of ±40% of the mean grain size is preferred.

As a system for reacting a soluble silver salt and a soluble halide, a single jet method, a double jet method, or a combination thereof may be used.

A so-called reverse mixing method for forming silver halide grains in the presence of excess silver ions can also be employed.

As a preferred double jet method, a so-called controlled double jet method by keeping a constant pAg in a liquid phase and forming silver halide therein can be used, and by this method, a silver halide emulsion containing silver halide grains having a regular crystal form and almost uniform grain size are obtained.

The silver halide grains are preferably formed under an acidic condition. According to the inventors' experimentation, the effects of the present invention are lowered if the silver halide grains are prepared under a neutral or alkaline condition. In the formation of the silver halide grains, the pH is preferably 6 or less, and more preferably 5 or less.

Details of silver halide emulsions and the preparation methods thereof are described in *Research Disclosure*, Vol. 176, RD No. 17643 (December, 1978), pp. 22–23, and in the original literature references cited therein.

The lithographic development system and the FSL development system are described below.

In these systems, a polyalkylene oxide compound is added in a photosensitive material or a processing solution. The polyalkylene oxide compound for use in this invention includes the condensation products of polyalkylene oxides composed of at least 10 units of alkylene oxide having from 2 to 4 carbon atoms, such as ethylene oxide, propylene-1,2-oxide, butylene-1,2-oxide, etc., preferably ethylene oxide, and a compound having at least one active hydrogen, such as water, an aliphatic alcohol, an aromatic alcohol, a fatty acid, an organic amine, a hexitol derivative, etc., and block copolymers of two or more kinds of polyalkylene oxides. Specific examples of polyalkylene compounds are:

polyalkylene glycols,
polyalkylene glycol alkyl ethers
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol block copolymers,
polyalkylene glycol graft polymers, etc.

The polyalkylene oxide compound may contain not only one but also two or more polyalkylene oxide chains in the molecule thereof. In this case, each polyalkylene oxide chain may be composed of less than 10 alkylene oxide units, but the sum of the alkylene oxide units in the polyalkylene oxide compound molecule must be at least 10. When the molecule of the compound has two or more polyalkylene oxide chains, each chain may be composed of different alkylene oxide units, e.g., ethylene oxide and propylene oxide. The polyalkylene oxide compound for use in this invention preferably contains 14 to 100 alkylene oxide units.

Specific examples of polyalkylene oxide compounds which can be used in this invention are illustrated below but the invention is not to be construed as being limited to these compounds.

IV-1:

$$HO(CH_2CH_2O)_{10}H$$

IV-2:

$$C_{12}H_{25}O(CH_2CH_2O)_{15}H$$

IV-3:

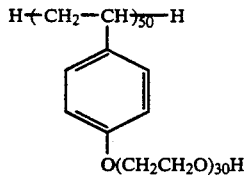

IV-4:

$$C_8H_{17}CH{=}CHC_8H_{16}O(CH_2CH_2O)_{15}H$$

IV-5:

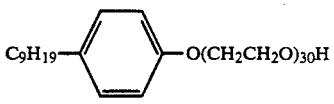

-continued

IV-6:

$$C_{11}H_{23}COO(CH_2CH_2O)_{80}H$$

IV-7:

$$C_{11}H_{23}CONH(CH_2CH_2O)_{15}H$$

IV-8:

$$C_{12}H_{25}N\begin{matrix}(CH_2CH_2O)_{15}H\\(CH_2CH_2O)_{15}H\end{matrix}$$

IV-9:

$$C_{14}H_{29}N(CH_2)(CH_2CH_2O)_{24}H$$

IV-10:

$$H(CH_2CH_2O)_a(\underset{\underset{CH_3}{|}}{C}HCH_2O)_b(CH_2CH_2O)_cH$$

$$a + b + c = 50$$
$$b/(a + c) = 10/9$$

The addition amount of the polyalkylene oxide compound is preferably from $10^{-4}$ to $10^2$ g, and particularly preferably from $10^{-3}$ to 10 g, per mol of silver halide.

The polyalkylene oxide compound may be added to, other than a processing solution, either a silver halide emulsion layer or a light-insensitive layer, or to both of them, but preferably a silver halide emulsion layer. When the polyalkylene oxide compound is incorporated in a silver halide emulsion layer, it may be added at any stage in preparation of the silver halide emulsion, e.g., on or after the chemical sensitization step.

The lith emulsion for use in the lithographic development system and the FSL Development system noted above is explained below.

As the silver halide composition, silver chlorobromide or silver chloroiodobromide containing at least 60 mol % (preferably at least 75 mol %) silver chloride and containing not more than 5 mol % silver iodide is preferred. There are no particular restrictions as to the form, crystal habit, grain size distribution, etc., of the silver halide crystals, but silver halide grains having grain sizes of less than 0.7 μm are preferred.

The form of the silver halide grains may be tabular, spherical, cubic, tetradecahedral, octahedral, etc. Also, a narrow grain size distribution is preferred and a so-called monodisperse silver halide emulsion wherein about 90%, preferably about 95%, of the total silver halide grain numbers are in the grain size range of ±40% of the mean grain size is preferred.

The silver halide emulsion may be chemically sensitized by a gold compound such as a chloroaurate, gold trichloride, etc., a salt of a noble metal such as iridium, etc., a sulfur compound forming silver sulfate by reacting with a silver salt, a reducing material such as a stannous salt, and amine, etc., without coarsening the grains, but chemically unsensitized grains are preferred.

In addition, at the time of physical ripening of silver halide grains, or upon nucleation, salts of noble metals like iridium, and iron compounds like a hexacyanoferrate(III) can be present.

In order to make a bright room-type photosensitive materials which can be handled substantially under bright light according to the present invention, a method of forming silver halide grains in the presence of an inorganic desensitizer, e.g., rhodium salts, iridium salts, cupric chloride, etc., which can lower sensitivities of silver halide emulsions in the extreme; a method of adding an organic desensitizer such as pinakryptol yellow, phenosafranine, etc., to emulsions; a method of incorporating into photosensitive materials dyes such as to have light absorption in the region corresponding to a long wavelength side of the intrinsic sensitivity region of silver halide (safelight dyes) so that the photosensitive materials may not have sensitivity in the wavelength region of safelight of the kind which can make us feel substantially light; and so on can be employed.

Such an inorganic desensitizer as described above is used in an amount of $10^{-7}$ mole or more, and particularly preferably from $10^{-6}$ mole to $10^{-3}$ mole, per mole of silver.

Particularly in the hydrazine contrast development system, it is more advantageous to use a water-soluble rhodium salt as a desensitizer, because it can enhance to a greater extent the security for handling the photosensitive material in a bright room. Preferred examples of rhodium salts which can be used include rhodium chloride, rhodium trichloride, rhodium ammonium chloride, and the like. Complex salts of these rhodium salts can also be used.

The above-described rhodium salts can be added at any stage of emulsion-making, provided that it is before completion of the first ripening. However, it is particularly desirable to add them during the grain formation. A suitable amount of the rhodium salt added ranges from $1\times10^{-7}$ to $1\times10^{-4}$ mole, and particularly preferably from $1\times10^{-6}$ to $5\times10^{-5}$ mole, per mole of silver.

An organic desensitizer is preferably incorporated in an amount of $10^{-5}$ mole or more, and particularly preferably from $10^{-5}$ to $10^{-2}$ mole, per mole of silver.

Methods of making it feasible to handle a photosensitive material in a bright room using these desensitizers are described in detail, for example, in Japanese Patent Application (OPI) Nos. 190943/83 and 157630/84, and so on.

In the case of using a safelight dye, a dye which lowers the sensitivity of a silver halide emulsion in the 400 nm or longer portion of the intrinsic light-sensitive wavelength region, more preferably a dye which exhibits its absorption maximum in the 420 to 550 nm portion, is preferably incorporated in the photosensitive material.

Such dyes are not particularly restricted as to chemical structure. Usable dyes for this purpose include oxonol dyes, hemioxonol dyes, merocyanine dyes, cyanine dyes, azo dyes, arylidene dyes, and so on. Of these dyes, water-soluble dyes are useful in that they are not left as color stain after photographic processing.

This method is described in detail in Japanese Patent Application No. 206258/85.

More specifically, pyrazolone oxonol dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284 and 3,718,472, enamihemioxonol dyes described in U.S. Pat. No. 3,976,661, arylidine dyes described in Japanese Patent Application (OPI) Nos. 3623/76 and 20822/77, bis-form dyes described in Japanese Patent Application Nos. 54883/85, 21306/85, 117456/85 and 178324/85, dyes described in British Patents 584,609 and 1,177,429, Japanese Patent Application (OPI) Nos. 85130/73, 99620/74 and 114420/74, U.S. Pat. Nos. 2,533,472, 3,148,187, 3,177,078, 3,247,127, 3,540,887, 3,575,704 and 3,653,905, and so on can be used therein.

Specific examples of the foregoing dyes are illustrated below. However, the present invention is not to be construed as being limited to these examples.

V-1

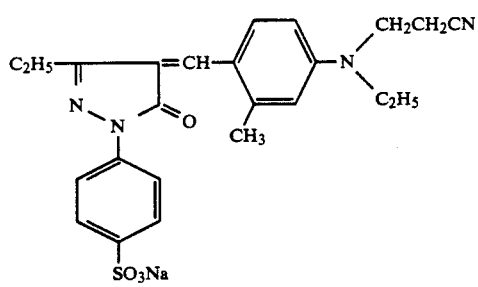

V-2

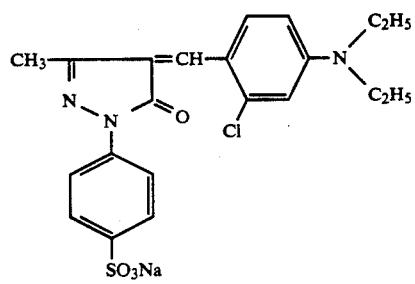

-continued
V-3
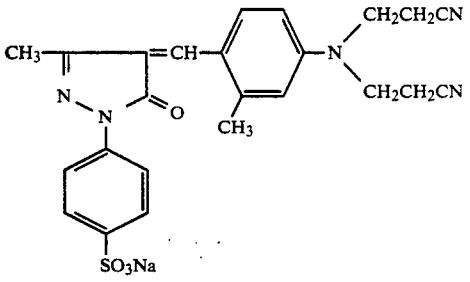
V-4
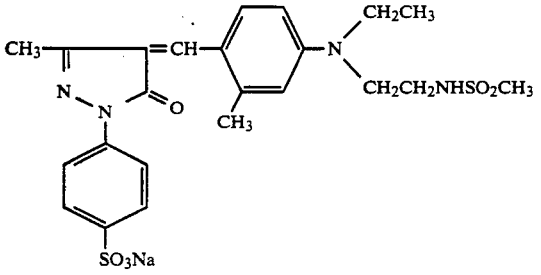
V-5
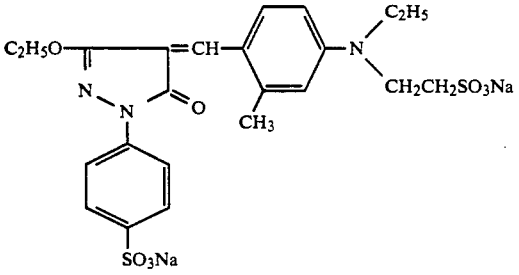
V-6
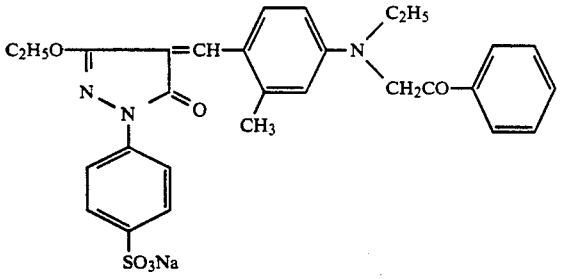
V-7
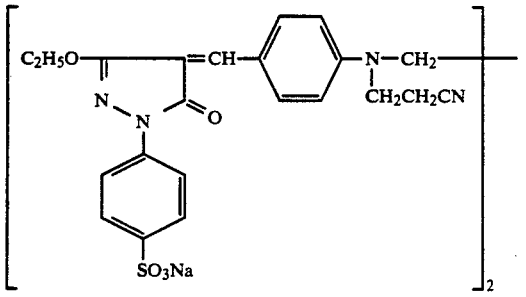

-continued
V-8
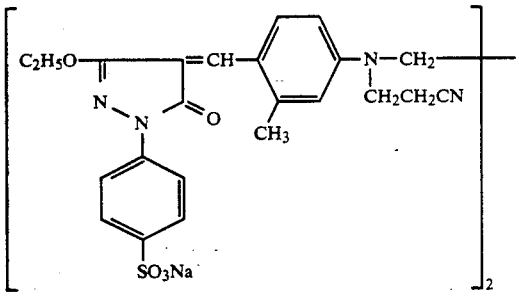
V-9
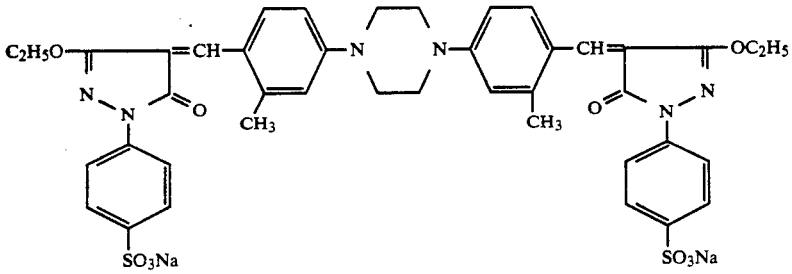
V-10
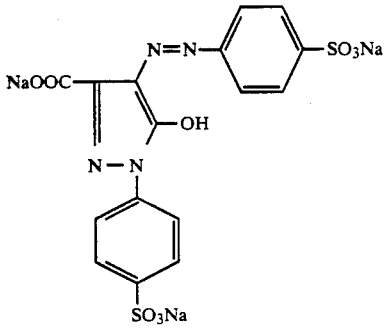
V-11
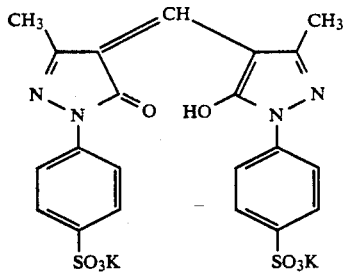
V-12
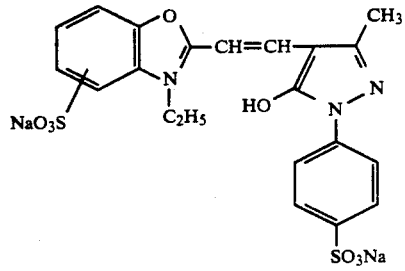

-continued

V-13

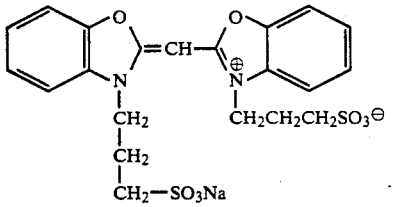

V-14

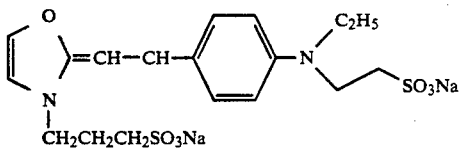

These dyes may be added directly to silver halide emulsions or hydrophilic colloids, or those previously dissolved in water or organic solvents may be added thereto. In addition, they may be added together with mordants.

The addition amount of these dyes ranges preferably from 10 mg to 400 mg, and particularly preferably from 20 mg to 300 mg, per square meter of photosensitive material.

Bright room-type photosensitive materials having $\gamma$ of 10 or more, which are intended by the present invention, can be prepared in the combination of one of the above-described methods with one of the development systems described hereinbefore.

In the photosensitive material of the present invention, one or more kinds of silver halide emulsions (with respect to grain size, and halogen formation) may be used. Further, the silver halide emulsion layer may be a single layer, or a multilayer (e.g., two or three layers) using the same or different silver halide emulsions.

The photosensitive material for use in this invention may contain various compounds for preventing the formation of fog during the production, storage and photographic processing of the photosensitive material or stabilizing the photographic performance thereof. For example, antifoggants or stabilizers, for example, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione, etc.; azaindenes such as triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, etc., may be used.

The photographic emulsion layers and the light-insensitive hydrophilic colloid layer(s) used in this invention may further contain an inorganic or organic hardening agent such as a chromium salt (chromium alum, chromium acetate, etc.), an aldehyde (e.g., formaldehyde, glyoxal, glutaraldehyde, etc.), an N-methylol compound (e.g., dimethylolurea, methyloldimethylhydantoin, etc.), a dioxane derivative (e.g., 2,3-dihydroxydioxane, etc.), an active vinyl compound (e.g., 1,3,5-triacryloyl-hexahydro-s-triazine, bis(vinylsulfonyl)methyl ether, N,N'-methylene-bis[$\beta$-(vinylsulfonyl)propionamido], etc.), an active halogen compound (e.g., 2,4-dichloro-6-hydroxy-s-triazine, etc.), a mucohalogenic acid (e.g., mucochloric acid, mucophenoxychloric acid, etc.), an iso-oxazole, dialdehyde starch, 2-chloro-6-hydroxytriazinylated gelatin, etc. These compounds may be used alone or as a combination thereof.

Specific examples of these compounds are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644 and 4,543,292, British Patents 676,628, 825,544 and 1,270,578, German Patents 872,153 and 1,090,427, Japanese Patent Publication Nos. 7133/59 and 1872/71, Japanese Patent Application (OPI) Nos. 41221/78, 57257/78, 162546/84 and 80846/85, etc.

In these compounds, the active vinyl compounds described in the above-mentioned Japanese Patent Applications (OPI) Nos. 41221/78, etc., and the active halides described in U.S. Pat. No. 3,325,287 are preferred.

As a binder or a protective colloid for the photographic emulsions, gelatin is advantageously used but other hydrophilic colloids can be also used. For example, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc., sugar derivatives such as sodium alginate, starch derivatives, etc.; and various synthetic hydrophilic homopolymers and copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used.

Limed gelatin and also acid-treated gelatin may be used as the gelatin. Furthermore, hydrolyzed products of gelatin and enzyme decomposition products of gelatin can be also used.

The photosensitive materials for use in this invention may further contain, in the photographic emulsion layers or other hydrophilic colloid layers, various kinds of surface active agents for the purposes of coating aids, static prevention, the improvement of slidability, the improvement of dispersibility, adhesion prevention, and the improvement of photographic properties (e.g., the acceleration of development and the increase of contrast and sensitivity).

The photosensitive materials for use in this invention can further contain a dispersion of a water insoluble or water sparingly soluble synthetic polymer for the purpose of improving dimensional stability, etc. For example, homopolymers or copolymers of alkyl (meth)acrylate, alkoxyalkyl (meth)acrylate, glycidyl (meth)acrylate, (meth)acrylamide, vinyl esters (e.g., vinyl acetate), acrylonitrile, olefins, styrene, etc., alone or as a combination thereof, or a combination of the above described monomer and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc. Examples of these polymers are described in U.S. Pat. Nos. 2,376,005, 2,739,137, 2,853,457, 3,062,674, 3,411,911, 3,488,708, 3,525,620, 3,607,290, 3,635,715 and 3,645,740, British Patents 1,186,699 and 1,307,373, etc.

It is preferred for the photosensitive materials for use in this invention to contain a compound having an acid group in the silver halide emulsion layers or other hydrophilic colloid layers. Examples of such a compound having an acid group are organic acids such as salicylic acid, acetic acid, ascorbic acid and polymers or copolymers having an acid monomer such as acrylic acid, maleic acid, phthalic acid, etc., as a recurring unit. For these compounds, the descriptions of Japanese Patent Application Nos. 66179/85 (corresponding to U.S. Patent Application Ser. No. 845,298 filed Mar. 28, 1986), 68873/85 (corresponding to U.S. patent application Ser. No. 846,679 filed Apr. 1, 1986), 163856/85, and 195655/85 (corresponding to U.S. patent application Ser. No. 904,062 filed Sept. 4, 1986) can be referred.

Particularly preferred compounds of these compounds are ascorbic acid as a low molecular weight compound and a water-dispersible latex of a copolymer composed of an acid monomer such as acrylic acid, etc., and a crosslinking monomer having at least 2 unsaturated groups such as divinylbenzene, as a high molecular weight compound.

The silver halide emulsions for use in this invention may be spectrally sensitized using a short wavelength sensitizing dye, but it is preferably not spectrally sensitized.

For the silver halide photographic materials for use in this invention, various kinds of additives can be present. For example, desensitizers, coating aids, anti-static agents, plasticizers, sliding agents, development accelerators, oils, dyes, etc., can be present.

These additives are described, for example, in *Research Disclosure,* RD No. 17643 (December, 1978), pp. 22–31, etc.

The emulsion layer and a protective layer in the photosensitive material of the present invention may be a single layer or multilayer. In the case of multilayer, an interlayer may further be provided therebetween.

The photosensitive material for use in this invention has photographic emulsion layers and other hydrophilic colloid layer(s) on one or both surface of a flexible support. Films composed of a synthetic polymer such as cellulose acetate, cellulose acetate butyrate, polystyrene, polyethylene terephthalate, etc., are useful as the flexible support.

As processing solutions such as developer, etc., known processing solution can be used in this invention.

Specifically, the developer for use in this invention may be selected from a PQ developer, an MQ developer, and a lith developer as follows.

That is, the developer may be selected depending on the kind and sensitivity of the photosensitive materials to be processed, the kind and sensitivity of the contrast-increasing system employed.

Details of the development process for use in this invention are described in *Research Disclosure,* Vol. 176, RD No. 17643, Paragraphs XIX, XX, and XXI, pp 28–39 (December, 1978).

The developers which are used in the hydrazine or tetrazolium contrast development system described above are further explained below.

For obtaining extremely high contrast photographic characteristics ($\gamma$ value of at least 10) by using a silver halide photographic material using a hydrazine derivative or a tetrazolium compound, it is unnecessary to use a conventional unstable lith developer (infectious developer) or a highly alkaline developer having a pH of about 13 as described in U.S. Pat. No. 2,419,975; rather, a stable developer can be used. That is, the above-described photographic characteristics can be obtained by processing the above-described silver halide photographic material with a developer containing a sufficient amount (in particular, higher than 0.15 mol/liter) of sulfite ion. The pH of the developer is preferably at least 9.5, and more preferably from 10.5 to 12.3, in the case of using a hydrazine derivative, and is preferably from 9 to 12, and more preferably from 10 to 11, in the case of using a tetrazolium compound.

There is no particular restriction on the developing agent for the developer used in these systems but the use of a dihydroxybenzene is preferred from the point of ease of obtaining good dot quality. A combination of a dihydroxybenzene and a 1-phenyl-3-pyrazolidone or a combination of a dihydroxybenzene and a p-aminophenol may be used.

Hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc. may be used as the dihydroxybenzene developing agent. In these materials, hydroquinone is particularly preferred in this invention.

Examples of 1-phenyl-3-pyrazolidone and derivatives thereof which can be used as the developing agent together with the dihydroxybenzene are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

Examples of a p-aminophenol which can be used as the developing agent together with the dihydroxybenzene are N-methyl-p-aminophenol, p-aminophenol, N-($\beta$-hydroxyethyl)-p-aminophenol, N-hydroxyphenylglycine 2-methyl-p-aminophenol, p-benzylaminophenol, etc. In these materials, N-methyl-p-aminophenol is preferred.

It is preferred that the developing agent be used in an amount of from 0.05 mol/liter to 0.8 mol/liter. Also, the developing agent can be composed of a combination of a dihydroxybenzene and a 1-phenyl-3-pyrazolidone or a combination of a dihydroxybenzene and a p-aminophenol, it is preferred that the amount of the dihydroxybenzene is from 0.05 mol/liter to 0.5 mol/liter and the amount of the pyrazolidone or the p-aminophenol is from less than about 0.06 mol/liter.

Sodium sulfite, potassium sulfite, lithium sulfite, ammonium sulfite, sodium hydrogensulfite, potassium metahydrogensulfite, potassium metahydrogensulfite, sodium formaldehyde hydrogensulfite, etc. can be used as sulfate preservatives for use in the hydrazine or tetrazolium contrast development system. The amount of the sulfite is preferably at least 0.4 mol/liter, particularly preferably at least 0.5 mol/liter. The upper limit thereof is preferably 2.5 mol/liter.

Alkali agents for adjusting the pH of the developer include pH controlling agents and buffers, such as sodium hydroxide, potassium hydroxide, sodium carbonate, potassium carbonate, sodium tertiary phosphate, potassium tertiary phosphate, etc.

The developers for use in these systems may further contain various additives in addition to the above-described materials. Examples of these additives are development inhibitors such as boric acid, borax, sodium bromide, potassium bromide, potassium iodide, etc.; organic solvents such as ethylene glycol, diethylene glycol, triethylene glycol, dimethylformamide, methyl cellosolve, hexylene glycol, ethanol, methanol, etc.; and antifoggants or "black pepper" preventing agents such as mercapto series compounds (e.g., 1-phenyl-5-mercaptotetrazole, sodium 2-mercaptobenzimidazole-5-sulfonate, etc.), indazole series compounds (e.g., 5-nitroindazole, etc.), benzotriazole series compounds (e.g., 5-methylbenzotriazole, etc.), etc.

Furthermore, the developers may contain, if desired, toning agents, surface active agents, defoaming agents, water softeners, hardening agents, the amino compounds described in Japanese Patent Application (OPI) No. 106244/81.

It is preferred that the development temperature be from 18° to 50° C., more preferably from 25° to 43° C., and the development time be from 15 to 60 seconds in the hydrazine or tetrazolium contrast development system.

The lith developer for use in the lithographic development system described above is explained below.

The lith developer which is preferably used in this invention is fundamentally comprised of o- or p-dihydroxybenzene, an alkali agent, a small amount of a free sulfite, and a sulfite ion buffer.

The o- or p-dihydroxybenzene as a developing agent can be suitably selected from known agents. Specific examples of dihydroxybenzenes are hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Of these materials, hydroquinone is particularly preferred. These developing agents may be used alone or as a mixture thereof.

The addition amount of the developing agent is from 1 to 100 g, and preferably from 5 to 80 g, per liter of developer.

A sulfite ion buffer is used in an amount effective for maintaining the sulfite concentration in the developer at an almost constant value and examples thereof are a aldehyde-alkali hydrogensulfite addition product such as a formaldehyde-sodium hydrogensulfite addition product, etc.; a ketone-alkali hydrogensulfite addition product such as an acetone-sodium hydrogensulfite addition product, etc., a carbonyl hydrogensulfite-amine condensation product such as sodium-bis(2-hydroxyethyl)aminomethane sulfonate, etc. The amount of the sulfite ion buffer is from 13 to 130 g per liter of developer.

To the developer for use in this system can be added an alkali sulfite such as sodium sulfite, etc., for controlling the free sulfite ion concentration. The addition amount thereof is generally less than about 5 g, preferably less than 3 g, per liter of developer but may be, as a matter of course, larger than 5 g per liter of developer.

In many cases, it is preferred that the developer contain an alkali halide (in particular, a bromide such as sodium bromide, potassium bromide, etc.) as a development controlling agent. The amount of the alkali halide is from 0.01 to 10 g, preferably from 0.1 to 5 g, per liter of developer.

The developer usually contains an alkali agent such as sodium carbonate, potassium carbonate, etc., in various amounts so as to adjust the pH of the developer to 9 or more, and preferably from 9.7 to 11.5.

The developers for use in this system may contain, if desired, pH buffers such as water-soluble acids (e.g., acetic acid, boric acid, etc.), alkalis (e.g., sodium hydroxide, etc.), salts (e.g., sodium carbonate, etc.), etc. Certain alkalis function not only as an alkalifying agent for developer but also as a pH buffer and a development controlling agent. Other components which can be further added to the developers are preservatives such as diethanolamine, ascorbic acid, kojic acid, etc., antifoggants such as benzotriazole, 1-phenyl-5-mercaptotetrazole, etc., organic solvents such as triethylene glycol, dimethylformamide, methanol, etc.

The developer may contain the necessary components as described above at use and the composition of the developer may be divided into two or more components before use. For example, if the developer is divided into a portion containing a developing agent and a portion containing an alkali, they can be stably stored and can be immediately used by mixing both the portions with dilution at use.

As a matter of course, by using a powder type developer or a liquid type developer, good photographic performance can be obtained.

In the lithographic development system, the development temperature is preferably from 20° C. to 40° C. but other temperatures than outside of the range may also be employed. The development time is depends upon the development temperature, but is generally from 10 seconds to 250 seconds, preferably from 10 seconds to 150 seconds.

A developing solution used in the FSL development system is a high pH developer containing a dihydroxybenzene developing agent, a high concentration of sulfite ion (specifically 0.2 mol/l or more), and a nitroindazole compound.

Dihydroxybenzene developing agents usable in the high pH developer include the same ones as used in the above-described lith developer. In particular, hydroquinone is used to advantage. For the purpose of keeping a sulfite ion concentration constant, a sulfite ion buffer as described above can be used, if desired. Specifically, the above-described sulfites or sulfite ion buffers can be used in this development system as well.

A preferred pH of this developer is 10.5 or higher.

Nitroindazole compounds and developers which can be used in this system are described in detail in Japanese Patent Application (OPI) No. 190943/83.

A development temperature in this system is preferably from 30° to 50° C., and a preferred development time is from 10 to 60 seconds.

In the above four development systems, the developer may further contain silver-stain preventing agents described in Japanese Patent Application (OPI) No. 24347/81, dissolution aids described in Japanese Patent Application (OPI) No. 267759/86, etc. A pH buffer such as boric acid described in Japanese Patent Application No. 28708/86, sugar (e.g., saccharose), oximes (e.g., acetooxime), phenols (e.g., 5-sulfosalicylic acid), and tertiary phosphates (e.g., sodium salt, potassium salt thereof) as described in Japanese Patent Application (OPI) No. 93433/85 may further be added, with boric acid being preferred.

As for the fixing solution, those having generally used compositions, can be employed. Fixing agents which can be contained therein include not only thiosulfates and thiocyanates, but also organic sulfur compounds which are known to have a good fixing effect. The fixing solution may contain a water-soluble aluminum salt (e.g., aluminium sulfate, alum, etc.) as a hardener. The water-soluble aluminium salt is generally present in a concentration of up to 1.4 g/liter on an Al basis. In addition, a trivalent iron compound can be used as oxidant in the form of an (ethylenediaminetetraacetato)iron(III) complex.

The present invention is now illustrated in greater detail by reference to the following examples.

EXAMPLE 1

Solution I: water 600 ml, gelatin 18 g, pH 3.0.

Solution II: $AgNO_3$ 200 g, water 800 ml.

Seed emulsions A and B were prepared using the above-described solutions I and II according to the following method.

(1) Emulsion A (Br: 1 mol %, grain size: 0.20 micron, Rh: $1.0\times10^{-5}$ mol/mol Ag)

Solution $III_A$: KBr 1.4 g, NaCl 76 g, $NH_4RhCl_6$ 4 mg, water 800 ml

The solutions II and $III_A$ were added simultaneously at a constant speed to the solution I kept at 40° C. according to the double jet method. It took 20 minutes to finish the addition. After removal of soluble salts from the emulsion using a conventional method well-known in the art, gelatin was added and then, 2-methyl-4-hydroxyl-1,3,3a,7-tetraazaindene was added as a stabilizer without carrying out chemical ripening. The thus obtained emulsion had a mean grain size of 0.20 micron, yield of 1 Kg, and a gelatin content of 60 g. This emulsion was named Emulsion A. To Emulsion A was added a polyalkylene oxide compound (PEO)

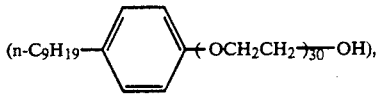

which was designated as Emulsion A-1. Separately, a tetrazolium salt (T-salt)

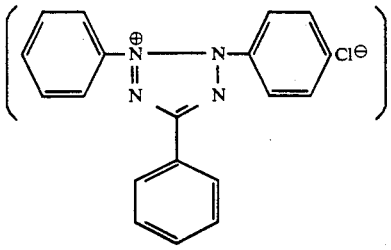

was added to Emulsion A. The resulting emulsion was designated as Emulsion A-2. Still another emulsion was prepared by adding a hydrazine compound (Hz)

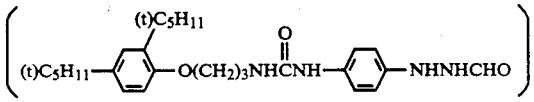

to Emulsion A, and named Emulsion A-3. An ultraviolet absorbent (UV absorbent) (Compound I-2) was added to separate fractions of Emulsions A-1 to A-3 in different amounts as set forth in Table 1. Therefore, polyethylacrylate latex was added to each fraction in a proportion of 30 wt % to gelatin on a solid basis and thereto, 1,3-vinylsulfonyl-2-propanol was further added as a hardener. The resulting fractions were each coated on a polyethylene terephthalate film at a coverage of 4.0 g/m² on a Ag basis and thereon, a protective layer, to which an yellow dye (Compound V-5) was previously added so as to have a coverage of 120 mg/m² for improving on safelight security, was provided, at a coverage of 1.5 g/m² on a gelatin basis, to prepare samples. Each sample was exposed to light through an optical wedge using a bright room-type printer P-607, made by Dainippon Screen Mfg. Co., Ltd., and then subjected to standard processings in each development system. The $\gamma$ values of the processed samples were determined (according to the method described before) and shown in Table 1.

The development processing of sample Nos. A-1-a to A-1-e was carried out using a lith developer HS-5 or a FSL developer FS-2 (both are products of Fuji Photo Film Co., Ltd.), that of sample Nos. A-2-a to A-2-e was carried out using Developer A, and that of Sample Nos. A-3-a to A-3-e was carried out using Developer B.

TABLE 1

| Sample No. | Emulsion Used | Compound for Increasing Contrast: Name | Compound for Increasing Contrast: Amount Added (mol/mol Ag) | Coverage of UV Absorbent I-2 (mg/m²) | Gradation $\gamma$ |
|---|---|---|---|---|---|
| A-1-a | A-1 | PEO | $1\times10^{-4}$ | — | 17 (HS-5), 15 (FS-2) |
| A-1-b | " | " | " | 50 | 15.5 (HS-5), 13.5 (FS-2) |
| A-1-c | " | " | " | 100 | 15 (HS-5), 13 (FS-2) |
| A-1-d | " | " | " | 150 | 13 (HS-5), 11 (FS-2) |
| A-1-e | " | " | $0.1\times10^{-4}$ | 100 | 8.2 (HS-5), 7.5 (FS-2) |
| A-2-a | A-2 | T-salt | $5\times10^{-3}$ | — | 14 (Developer A) |
| A-2-b | " | " | " | 50 | 13 (Developer A) |
| A-2-c | " | " | " | 100 | 11.5 (Developer A) |
| A-2-d | " | " | " | 150 | 10.5 (Developer A) |
| A-2-e | " | " | $0.5\times10^{-3}$ | 100 | 8.5 (Developer A) |
| A-3-a | A-3 | HZ | $4\times10^{-4}$ | — | 20 (Developer B) |
| A-3-b | " | " | " | 50 | 19 (Developer B) |
| A-3-c | " | " | " | 100 | 17.5 (Developer B) |
| A-3-d | " | " | " | 150 | 15 (Developer B) |

TABLE 1-continued

| Sample No. | Emulsion Used | Compound for Increasing Contrast Name | Amount Added (mol/mol Ag) | Coverage of UV Absorbent I-2 (mg/m²) | Gradation γ |
|---|---|---|---|---|---|
| A-3-e | " | " | $0.4 \times 10^{-4}$ | 100 | 9.3 (Developer B) |

(2) Emulsion (Br: 2 mol %, grain size: 0.25 micron, Rh: $1.0 \times 10^{-4}$ mol/mol (Ag)

Solution $III_B$: KBr 2.8 g, NaCl 75 g, $NH_4RhCl_6$ 40 mg, water 800 ml

Emulsion B was prepared using Solutions I, II, and $III_B$ in the same manner as in the preparation of Emulsion A. Samples A-1-a to A-2-e were made in the same manner as Samples A-1-a to A-2-e except that Emulsion B was used in place of Emulsion A, and no yellow dye was incorporated in the samples.

The thus obtained samples were optically exposed, and development-processed in the same manner as the samples comprising Emulsion A. The results obtained are shown in Table 2.

TABLE 2

| Sample No. | Emulsion Used | Compound for Increasing Contrast Name | Amount Added (mol/mol Ag) | Coverage of UV Absorbent I-2 (mg/m²) | Developer Use | Gradation γ |
|---|---|---|---|---|---|---|
| B-1-a | B-1 | PEO | $2 \times 10^{-4}$ | — | HS-5 | 15 |
| B-1-b | " | " | " | 100 | " | 14 |
| B-1-c | " | " | " | 200 | " | 13.5 |
| B-1-d | " | " | " | 400 | " | 12 |
| B-1-e | " | " | $0.2 \times 10^{-4}$ | 200 | " | 7.2 |
| B-2-a | B-2 | T-salt | $5 \times 10^{-3}$ | — | Developer A | 13 |
| B-2-b | " | " | " | 100 | " | 12 |
| B-2-c | " | " | " | 200 | " | 11 |
| B-2-d | " | " | " | 400 | " | 10.3 |
| B-2-e | " | " | $0.5 \times 10^{-3}$ | 200 | " | 8.5 |

(3) Sample No. A-1-a to Sample No. A-1-e were subjected to imagewise exposure under conditions as described in Table 3. Therein, originals and the photosensitive sample took a configulation as illustrated in FIG. 1. Then, development was carried out using an automatic developing machine FG 660 (made by Fuji Photo Film, Co., Ltd.). Therein, a lith developer HS-5 (produced by Fuji Photo Film Co., Ltd.) was employed as a developing solution, the development temperature was 32° C., and the development time was 60 seconds. The qualities of the thus obtained letter images were evaluated.

Figure 2:
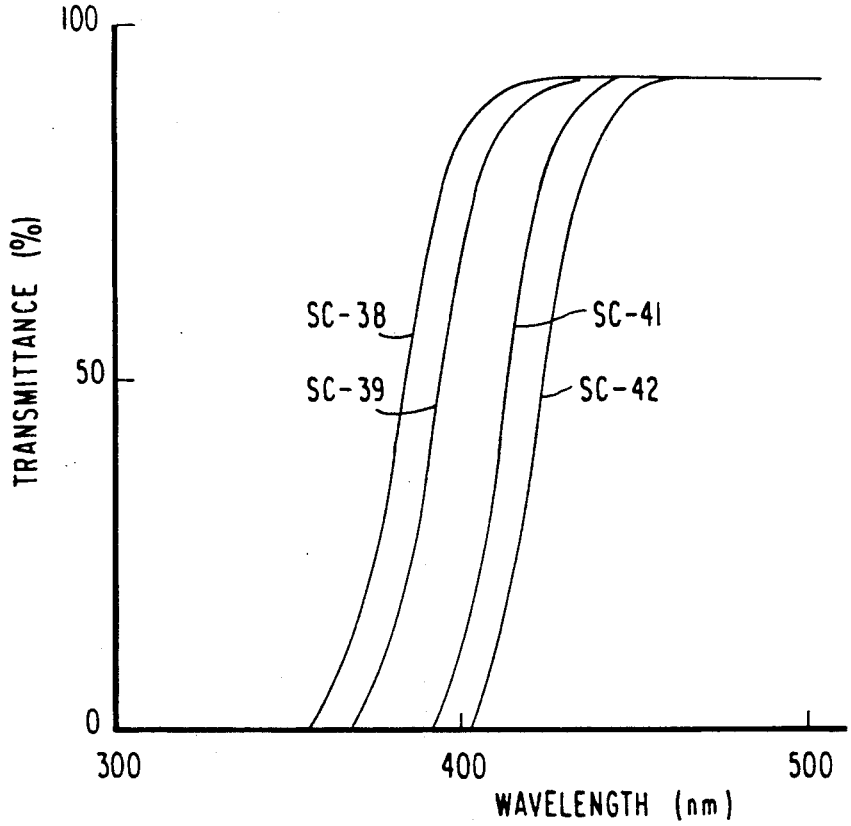
FIG. 2 is a graph showing respective spectral transmittances of optical filters SC-38, SC-39, SC-41, and SC-42 used in Example 1 described below, wherein the ordinate is transmittance (%), and the abscissa is wavelength (nm).

Filters SC-38, SC-39 and SC-41, made by Fuji Photo Film Co., Ltd., were used as light source filters in combinations with light sources as described in Table 3. Spectral transmittances of these filters are shown in FIG. 2.

The quality "5" of letter images refers to such a quality that when originals and a contact-type photosensitive material were so arranged as to have the configuration illustrated in FIG. 1, and correct exposure was applied thereto by which 50% dot area on the halftone original could be reproduced as 50% dot area on the photosensitive material was given, letter images having a line width of 30 microns could be reproduced on the photosensitive material, that is to say, very excellent quality. On the other hand, the quality "1" of letter images refers to such a quality that when the same correct exposure as described above was applied, letter images having a line width of 150 microns or more could barely be reproduced, that is, the quality were quite inferior. The three ranks 4, 3, and 2 were designated between the quality "5" and the quality "1" on a basis of sensory evaluation. The ranks 3 or higher were practically usable. Upon exposure, exposure time for each sample was adjusted to the same seconds by controlling intensity of exposure with a neutral density filter. The results obtained are shown in Table 3.

TABLE 3

| Test No. | Sample No. | Coverage of UV Absorbent I-2 (mg/m²) | γ value | Exposure Light Source* | Light Source Filter | Quality of Letter Image | Note |
|---|---|---|---|---|---|---|---|
| 1 | A-1-a | — | 17 | (A) | Absent | 2 | Comparison |
| 2 | A-1-b | 50 | 15.5 | " | " | 3 | Invention |
| 3 | A-1-c | 100 | 15 | " | " | 4 | " |
| 4 | A-1-d | 150 | 13 | " | " | 4.5 | " |
| 5 | A-1-a | — | 17 | " | SC-38 | 3.5 | " |
| 6 | " | — | " | " | SC-39 | 4 | " |
| 7 | " | — | " | " | SC-41 | 4.5 | " |
| 8 | " | — | " | (B) | Absent | 4 | " |
| 9 | " | — | " | (C) | " | 4.5 | " |
| 10 | A-1-e | 100 | 8.2 | (A) | SC-39 | 1.5 | Comparison |
| 11 | A-1-b | 50 | 15.5 | " | SC-38 | 4.5 | Invention |
| 12 | " | " | " | " | SC-39 | 5 | " |
| 13 | " | " | " | (B) | Absent | 4.5 | " |
| 14 | " | " | " | (C) | " | 5 | " |

TABLE 3-continued

| Test No. | Sample No. | Coverage of UV Absorbent I-2 (mg/m²) | γ value | Exposure Light Source* | Light Source Filter | Quality of Letter Image | Note |
|---|---|---|---|---|---|---|---|
| 15 | " | " | " | (B) | SC-38 | 5 | " |

*Exposure light source (A): P-607, made by Dainippon Screen Mfg. Co., Ltd. (ultra-high pressure mercury lamp: ORC-CHM-1000)
Exposure light source (B): EYE DOLPIN made by EYE GRAPHIC Co., Ltd. (3 KW metal halide lamp: MQ-300)
Exposure light source (C): P-603, made by Dainippon Screen Mfg. Co., Ltd. (2 KW metal halide lamp: SPG-2000, made by Japan storage Battery Co., Ltd.)

Figure 3:
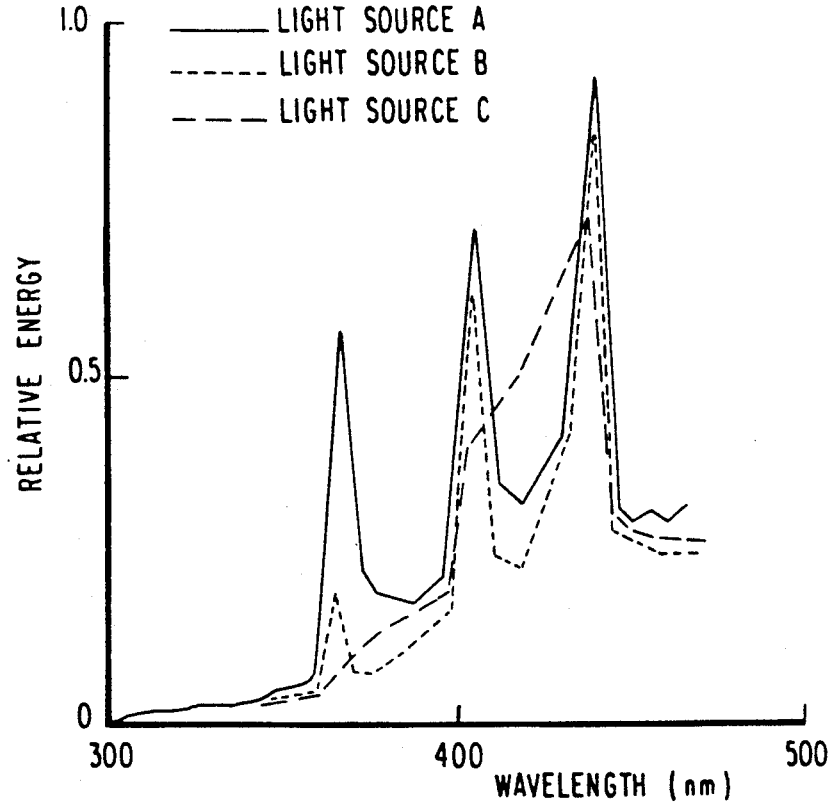
FIG. 3 is a graph showing respective spectral energy distributions of light sources (A), (B), and (C) employed upon optical exposure in Example 1, wherein the ordinate is relative energy, and the abscissa is wavelength (nm).
Figure 4:
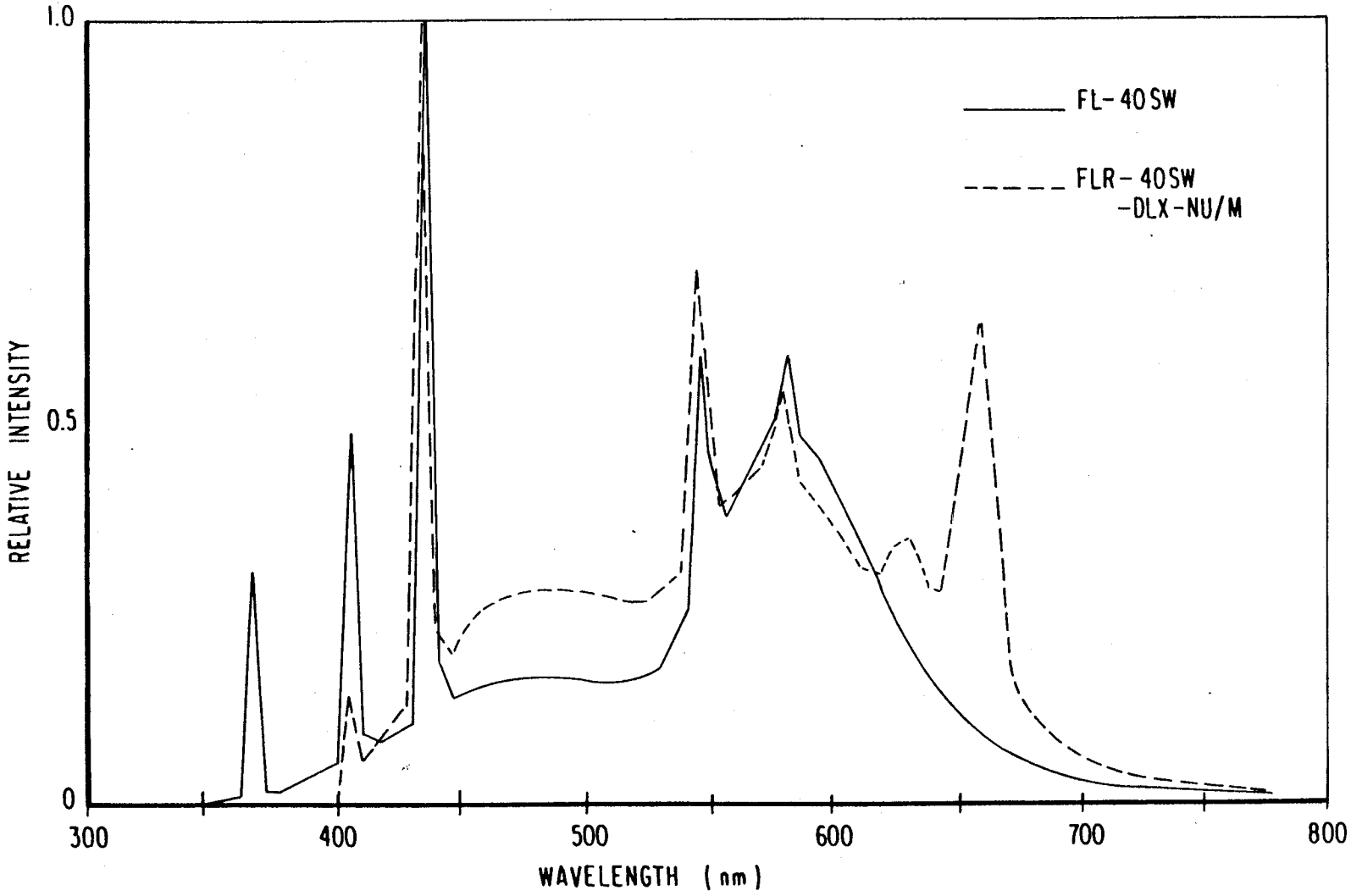
FIG. 4 is a graph showing respective emission energy distributions of fluorescent lamps FL-40SW and FLR-40SW-DLX-NU/M used in Example 1, wherein the ordinate is relative intensity and the abscissa is wavelength (nm).

The energy distributions of these light sources are shown in FIG. 3.

Safelight security Test:

The samples A-1-a to A-1-e each was exposed to a white fluorescent lamp (FL-40SW, made by Tokyo Shibaura Electric Co., Ltd.) round which a sharp-cut filter SC-42 (referred to FIG. 2), made by Fuji Photo Film Co., Ltd., was fastened as a safelight filter under illuminance of 200 lux for 1 hour. As a result of such exposure (and HS-5 processing), increases in Dmin values of these samples were less than 0.02, which are on such a level that they can be substantially handled under bright light.

Taking both the evaluation shown in Table 3 and the result of the safelight test into consideration, the photosensitive materials prepared in accordance with the present invention has proved to be those which can be handled in a bright room and provide images of high quality within the test level aimed by this invention.

(4) After the same exposure as in the foregoing examination (3), the sample No. A-2-a to the sample No. A-2-e were development-processed at 28° C. for 30 seconds (complete agitation) using Developer A to evaluate the qualities of the developed images according to the same criterion as described above. The results obtained are shown in Table 4.

TABLE 4

| Test No. | Sample No. | Coverage of UV Absorbent I-2 (mg/m²) | γ value | Exposure Light Source | Light Source Filter | Quality of Letter Image | Note |
|---|---|---|---|---|---|---|---|
| 16 | A-2-a | — | 14 | (A) | — | 1.5 | Comparison |
| 17 | A-2-b | 50 | 13 | " | — | 3 | Invention |
| 18 | A-2-c | 100 | 11.5 | " | — | 3.5 | " |
| 19 | A-2-d | 150 | 10.5 | " | — | 4 | " |
| 20 | A-2-a | — | 14 | " | SC-38 | 3 | " |
| 21 | " | — | " | " | SC-39 | 3.5 | " |
| 22 | " | — | " | " | SC-41 | 4 | " |
| 23 | " | — | " | (B) | — | 3.5 | " |
| 24 | A-2-e | 100 | 8.5 | (A) | SC-39 | 1.5 | Comparison |

The safelight security test was also carried out in a similar manner as above to obtain the same results as in the examination (3) (by the processing with Developer A).

In analogy with the contrast development system employed in the examination (3), the test level within the scope of the present invention has proved to be very high in this contrast development system also.

(5) After the same exposure as in the examination (3), the sample No. A-1-a to the sample No. A-1-e were development processed at 38° C. for 20 seconds using Developer FS-2 for FSL development system (produced by Fuji Photo Film Co., Ltd.) in an automatic developing machine FG-660F (made by Fuji Photo Film Co., Ltd.) to evaluate similarly the qualities of the developed images. The results obtained are shown in Table 5.

TABLE 5

| Test No. | Sample No. | Coverage of UV Absorbent I-2 (mg/m²) | γ value | Exposure Light Source | Light Source Filter | Quality of Letter Image | Note |
|---|---|---|---|---|---|---|---|
| 25 | A-1-a | — | 15 | (A) | — | 1.5 | Comparison |
| 26 | A-1-b | 50 | 13.5 | " | — | 3 | Invention |
| 27 | A-1-c | 100 | 13 | " | — | 3.5 | " |
| 28 | A-1-d | 150 | 11 | " | — | 4.5 | " |
| 29 | A-1-a | — | 15 | " | SC-38 | 3 | " |
| 30 | " | — | " | " | SC-39 | 3.5 | " |
| 31 | " | — | " | " | SC-41 | 4.5 | " |
| 32 | " | — | " | (B) | — | 3.5 | " |
| 33 | A-1-e | 100 | 7.5 | (A) | SC-39 | 1.5 | Comparison |

The safelight security test was also carried out in a similar manner as above to obtain the same results as in the examination (3) (by the processing with Developer FS-2).

In analogy with the contrast development system employed in the examination (3), the test level within the scope of the present invention has proved to be very high in this contrast development system also.

(6) After the same exposure as in the examination (3), the sample No. A-3-a to the Sample No. A-3-e were development processed at 38° C. for 20 seconds using Developer B in an automatic developing machine FG-660F (made by Fuji Photo Film Co., Ltd.) to evaluate similarly the qualities of the developed images. The results obtained are shown in Table 6.

TABLE 6

| Test No. | Sample No. | Coverage of UV Absorbent I-2 (mg/m²) | γ value | Exposure Light Source | Light Source Filter | Quality of Letter Image | Note |
|---|---|---|---|---|---|---|---|
| 34 | A-3-a | — | 20 | (A) | — | 2 | Comparison |
| 35 | A-3-b | 50 | 19 | " | — | 3.5 | Invention |
| 36 | A-3-c | 100 | 17.5 | " | — | 4 | " |
| 37 | A-3-d | 150 | 15 | " | — | 4.5 | " |
| 38 | A-3-a | — | 20 | " | SC-38 | 3.5 | " |
| 39 | " | — | " | " | SC-39 | 4 | " |
| 40 | " | — | " | " | SC-41 | 4.5 | " |
| 41 | " | — | " | (B) | — | 4 | " |
| 42 | " | — | " | (C) | — | 4.5 | " |
| 43 | A-3-e | 100 | 9.3 | (A) | SC-39 | 2 | Comparison |
| 44 | A-3-b | 50 | 19 | (A) | SC-39 | 4.5 | Invention |
| 45 | " | " | " | (B) | — | 4.5 | " |
| 46 | " | " | " | (B) | SC-39 | 5 | " |

The safelight security test was also carried out in a similar manner as above to obtain the same results as in the examination (3) (by the processing with Developer B).

In analogy with the contrast development system employed in the examination (3), the test level within the scope of the present invention has proved to be very high in this hydrazine contrast development system also.

(7) Upon exposure, the sample No. B-1-a to No. B-1-e or the sample No. B-2-a to No. B-2-e, the same original as used in the examination (3), and Exposure light source (D) (a 15 KW ultra-high pressure mercury lamp, H-15-L31, made by EYE GRAPHICS Co., Ltd.) were employed. The sample No. B-1-a to No. B-1-e were development-processed in the same manner a in the examination (3), while the samples No. B-2-a to No. B-2-e were development-processed in the same manner as in the examination (4). Evaluation of the qualities of the developed images was made using the same criterion as described before. The results obtained are shown in Table 7.

The light source (D) used herein had almost the same spectral energy distribution as the light source (A).

TABLE 7

| Test No. | Sample No. | Coverage of UV Absorbent I-2 (mg/m²) | γ value | Exposure Light Source | Light Source Filter | Quality of Letter Image | Note |
|---|---|---|---|---|---|---|---|
| 47 | B-1-a | — | 15 | (D) | — | 2 | Comparison |
| 48 | B-1-b | 100 | 14 | " | — | 2.5 | Invention |
| 49 | B-1-c | 200 | 13.5 | " | — | 3.5 | " |
| 50 | B-1-d | 400 | 12 | " | — | 4 | " |
| 51 | B-1-a | — | 15 | " | SC-38 | 3 | " |
| 52 | " | — | " | " | SC-39 | 4 | " |
| 53 | " | — | " | " | SC-41 | 4.5 | " |
| 54 | B-1-e | 200 | 7.2 | " | SC-39 | 1.5 | Comparison |
| 55 | B-2-a | — | 13 | " | — | 1.5 | " |
| 56 | B-2-b | 100 | 12 | " | — | 2 | Invention |
| 57 | B-2-c | 200 | 11 | " | — | 3 | " |
| 58 | B-2-d | 400 | 10.3 | " | — | 3.5 | " |
| 59 | B-2-a | — | 13 | " | SC-38 | 3 | " |
| 60 | " | — | " | " | SC-39 | 3.5 | " |
| 61 | " | — | " | " | SC-41 | 4 | " |
| 62 | B-2-e | 200 | 8.5 | " | SC-39 | 1.5 | Comparison |

The safelight security test was carried out under illuminance of 200 lux using a UV-cut fluorescent lamp (FLR-40SW-DLX-NU/M, made by Tokyo Shibaura Electric Co., Ltd.) to obtain results similar to those obtained in the examination (3).

As can be seen from both the results previously described above and those shown in Table 7, the level within the scope of the present invention was very high.

Developer A and Developer B used in foregoing examinations had the following compositions, respectively.

| | |
|---|---|
| Developer A | |
| Disodium ethylenediaminetetraacetate (dihydrate) | 0.75 g |
| Anhydrous potassium sulfite | 51.7 g |
| Anhydrous potassium carbonate | 60.4 g |
| Hydroquinone | 15.1 g |
| 1-Phenyl-3-pyrazolidone | 0.51 g |
| Sodium bromide | 2.2 g |
| 5-Methylbenzotriazole | 0.124 g |
| 1-Phenyl-5-mercaptotetrazole | 0.018 g |
| 5-Nitro-indazole | 0.106 g |
| Diethylene glycol | 98 g |
| Water to make | 1 l |
| | (pH = 10.5) |
| Developer B | |
| Hydroquinone | 45.0 g |
| N-methyl-p-aminophenol 1/2 sulfate | 0.8 g |
| Sodium hydroxide | 18.0 g |
| Potassium hydride | 55.0 g |
| 5-Sulfosalicylic acid | 45.0 g |
| Boric acid | 25.0 g |
| Potassium sulfite | 110.0 g |
| Disodium ethylenediaminetetraacetate | 1.0 g |
| Potassium bromide | 6.0 g |
| 5-Methylbenzotriazole | 0.6 g |
| n-Butyldiethanolamine | 15.0 g |
| Water to make | 1 l |

-continued (pH = 11.6)

EXAMPLE 2

An aqueous silver nitrate solution and an aqueous sodium chloride solution containing ammonium hexachlororhodate(III) in an amount of $5\times10^{-6}$ mole per mole of silver were mixed at 40° C. in a gelatin solution using a double jet method to make a monodisperse emulsion containing cubic silver chloride grains having a mean grain size of 0.2 micron. After the grain formation, water-soluble salts were removed from the emulsion using a conventional flocculation method and then, gelatin was added thereto. Further, $5\times10^{-3}$ mole of 4-hydroxy-6-methyl-1,3,3a,7-tetraazaindene and $4\times10^{-4}$ mole of 1-phenyl-5-mercaptotetrazole were added to the resulting emulsion as a stabilizer without carrying out any chemical ripening step.

The emulsion was prepared so as to contain 55 g of gelatin and 105 g of silver in a 1 Kg portion thereof. (The thus prepared emulsion was designated as Emulsion C).

Emulsion C was equally divided into fractions, and compounds of formula (II) (the hydrazine derivatives), the compound example numbers and the addition amounts of which are set forth in Table 8, were added to the fractions, respectively. In addition, the same latex as described in formula 3 of Preparation Example 3 in U.S. Pat. No. 3,525,620 was added as a polymer latex in an amount of 20 g per mole of silver, and furthermore, 1,3-vinylsulfonyl-2-propanol was added as a hardener. Each of the resulting emulsion fractions was coated on a polyethylene terephthalate transparent film at a coverage of 3.8 g/m$^2$ on a silver basis, and a gelatin layer was further provided as a protective layer on the emulsion coat at a coverage of 1.5 g/m$^2$ on a gelatin basis. In this protective layer, Yellow Dye V-5 was contained in an amount of 100 mg per square meter in order to improve on safelight security for visible light. Thus, photosensitive materials, to which the sample No. (1) to the sample No. (9) were assigned respectively, were obtained. Each of these samples was exposed to light through an optical wedge under the exposure condition (A) or (B) described below.

(A): Exposure carried out through a ND filter using a light source a printer Model P-607 (equipped with an ultra-high pressure mercury lamp, ORC-CHM-1000), made by Dainippon Screen Mfg. Co., Ltd. (Comparative Example)

(B): Exposure carried out through a sharp-cut filter SC-38 (made by Fuji Photo Film Co., Ltd.), which functions so as to block the ultraviolet portion of light, using as a light source a printer Model P-607 (equipped with an ultra-high pressure mercury lamp, ORC-CHM-1000), made by Dainippon Screen Mfg. Co., Ltd. (Invention)

The exposed samples were development-processed at 38° C. for 20 seconds with Developer B in an automatic developing machine FG-800RA, made by Fuji Photo Film Co., Ltd.

Originals and each photosensitive sample No. (1) to No. (9) were so arranged to have the configuration illustrated in FIG. 1 and thereto, such correct exposure that 50% dot area on the halftone original could be reproduced as 50% dot area on the photosensitive sample through the foregoing development processing, was given under the exposure conditions (A) and (B), respectively. By the contact process described above, letter image was formed on each photosensitive sample, and a line width thereof was measured with a microdensitometer. The results obtained are shown in Table 8.

The sensitivity was expressed in terms of a relative value of the reciprocal of an exposure required for providing a density of 4.0, taking the sensitivity of Sample No. (1) as 100.

The $\gamma$ value was determined by the method defined in this specification.

Reproducibility of the line width of a line original was evaluated by what line width the letter image had in the contact-type photosensitive material by conversion from the letters having a line width of 100 microns present on the surface of the original.

Figure 5:
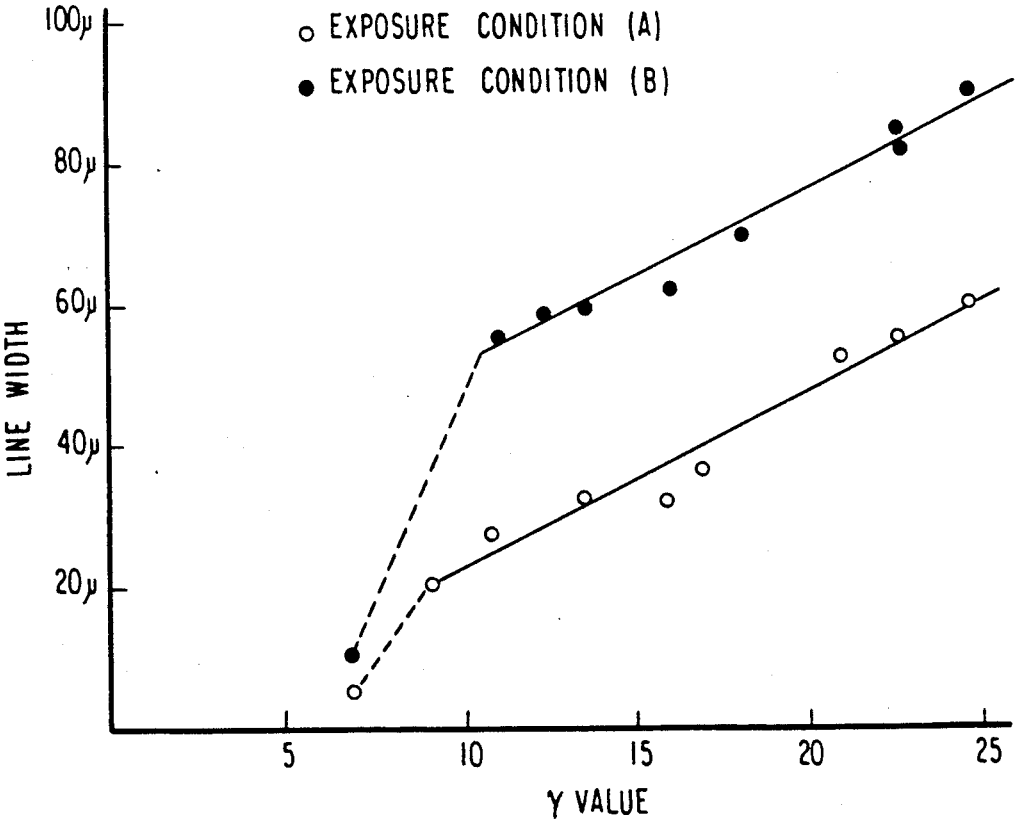
FIG. 5 is a graph obtained by plotting the data in Table 8, with gradation of image ($\gamma$ value) as abscissa and quality of letter image, i.e., line width ($\mu$m) of letter image as ordinate, wherein the white round marks represent the result obtained under exposure condition (A), and the black round marks represent the result obtained under exposure condition (B) in Example 2.

When the line width of letter images were plotted as the ordinate and the $\gamma$ value as the abscissa, the graph as shown in FIG. 5 was obtained. Letter images formed in the samples prepared in accordance with the invention, Nos. (2) to (9), under the exposure condition (B) came to have a line width wider than 50 microns, that is to say, hard to contract. Accordingly, the present invention can provide letter image of good quality.

TABLE 8

| Sample No. | Hydrazine Derivative (mol/mol Ag) | Condition (A) Sensitivity | Condition (A) $\gamma$ value | Condition (B) Sensitivity | Condition (B) $\gamma$ value | Line Width Reproducibility of Line Original: Exposure Condition (A) | Line Width Reproducibility of Line Original: Exposure Condition (B) |
|---|---|---|---|---|---|---|---|
| 1 | Absent | 100 | 6.9 | 100 | 6.9 | 5 μm | 10 μm |
| 2 | II-24 ($1\times10^{-3}$) | 190 | 16.9 | 190 | 18.0 | 36 μm | 70 μm |
| 3 | " ($4\times10^{-3}$) | 229 | 24.5 | 240 | 24.5 | 60 μm | 90 μm |
| 4 | II-25 ($1\times10^{-3}$) | 200 | 15.9 | 204 | 15.9 | 32 μm | 62 μm |
| 5 | " ($4\times10^{-3}$) | 224 | 20.8 | 229 | 22.5 | 52 μm | 85 μm |
| 6 | II-12 ($1\times10^{-3}$) | 148 | 9.0 | 148 | 10.8 | 20 μm | 55 μm |
| 7 | " ($4\times10^{-3}$) | 182 | 13.5 | 182 | 13.5 | 32 μm | 60 μm |
| 8 | II-33 ($1\times10^{-4}$) | 141 | 10.8 | 145 | 12.3 | 27 μm | 58 μm |
| 9 | " ($4\times10^{-4}$) | 219 | 22.5 | 229 | 22.5 | 55 μm | 82 μm |

While the invention has been described in detail and with reference to specific embodiments thereof, it will be apparent to one skilled in the art that various changes and modifications can be made therein without departing from the spirt and scope thereof.

What is claimed is:

1. A method for forming an image, which comprises providing a photosensitive material comprising at least one light-sensitive silver halide emulsion layer and having a $\gamma$ value greater than 10, the capability of being handled under bright light, and subjecting said light-sensitive layer to image-wise exposure to light substantially exclusive of wavelengths of 370 nm or shorter, said image-wise exposure to light being substantially exclusive of wavelengths of 370 nm or shorter is effected by a least one of positioning an optical filter for ultraviolet absorption between a light source and the photosensitive material and using a light source not having emission energy in a wavelength region below 370 nm, wherein a hydrazine derivative is contained in at least one of said light-sensitive silver halide emulsion layer or in another hydrophilic colloid layer of the photosensitive material.

2. A method as in claim 1, wherein said photosensitive material has a light-sensitive emulsion layer comprising a silver chloride emulsion or a silver chlorobromide emulsion having a chloride content of 80 mole % or more, and said emulsion contains a water-soluble rhodium salt in an amount of from $1\times10^{-7}$ to $1\times10^{-4}$ mole per mole of silver halide.

3. A method as in claim 1, wherein said imagewise exposure is effected by putting an optical filter for ultraviolet absorption between a light source and said photosensitive material.

4. A method as in claim 3, wherein said photosensitive material has a light-sensitive emulsion layer comprising a silver chloride emulsion or a silver chlorobromide emulsion having a chloride content of 80 mole % or more, and said emulsion contains a water-soluble rhodium salt in an amount of from $1\times10^{-7}$ to $1\times10^{-4}$ mole per mole of silver halide.

5. A method as in claim 1, wherein said imagewise exposure is effected by using a light source not having emission energy in a wavelength region below 370 nm.

6. A method as in claim 5, wherein said photosensitive material has a light-sensitive emulsion layer comprising a silver chloride emulsion or a silver chlorobromide emulsion having a chloride content of 80 mole % or more, and said emulsion contains a water-soluble rhodium salt in an amount of from $1\times10^{-7}$ to $1\times10^{-4}$ mole per mole of silver halide.

7. A method as in claim 1, wherein the grains of said silver halide emulsion are formed at a pH of 6 or less.

8. A method as in claim 2, wherein the grains of said silver halide emulsion are formed at a pH of 6 or less.

9. A method as in claim 1, wherein the grains of said silver halide emulsion are formed at a pH of 5 or less.

10. A method as in claim 2, wherein the grains of said silver halide emulsion are formed at a pH of 5 or less.

11. A method for forming an image, which comprises providing a photosensitive material comprising at least one light-sensitive silver halide emulsion layer and an ultraviolet absorbent having an absorption peak in the wavelength region of from 300–400 nm in an amount which reduces the intrinsic sensitivity of the silver halide emulsion at a wavelength of 360 nm to ½ or less and having a $\gamma$ value greater than 10, the capability of being handled under bright light, and subjecting said light-sensitive layer to image-wise exposure to light, wherein a hydrazine derivative is contained in at least one of said light-sensitive silver halide emulsion layer or in another hydrophilic colloid layer of the photosensitive material.

12. A method as in claim 11, wherein said photosensitive material has a light-sensitive emulsion layer comprising a silver chloride emulsion or a silver chlorobromide emulsion having a chloride content of 80 mole % or more, and said emulsion contains a water-soluble rhodium salt in an amount of from $1\times10^{-7}$ to $1\times10^{-4}$ mole of a silver halide.

* * * * *